US005749759A

United States Patent [19]

Hopper

[11] Patent Number: 5,749,759

[45] Date of Patent: May 12, 1998

[54] AQUADYNAMIC SWIM APPARATUS

[76] Inventor: William J. Hopper, 1270 North Marine Drive, Suite 101, Tamuning, Guam, 96911

[21] Appl. No.: 708,926

[22] Filed: Sep. 6, 1996

[51] Int. Cl.[6] ..... A63B 31/12

[52] U.S. Cl. ..... 441/60

[58] Field of Search ..... 441/60–64, 55; 440/14, 15; D21/239

[56] References Cited

U.S. PATENT DOCUMENTS

| | | | |
|---|---|---|---|
| 1,059,443 | 4/1913 | Cseki . | |
| 1,067,612 | 7/1913 | Lamb . | |
| 1,130,209 | 3/1915 | Sommerfeld . | |
| 1,192,650 | 7/1916 | Leitner . | |
| 2,792,577 | 5/1957 | Boyers . | |
| 2,898,611 | 8/1959 | Mooney . | |
| 3,078,482 | 2/1963 | Crowder | 441/60 |
| 5,326,296 | 7/1994 | De Jesus | 441/60 |
| 5,536,190 | 7/1996 | Athen | 441/64 |

FOREIGN PATENT DOCUMENTS

| | | | |
|---|---|---|---|
| 718500 | 1/1932 | France . | |
| 767505 | 7/1934 | France . | |
| 844617 | 7/1939 | France . | |
| 1114560 | 4/1956 | France . | |
| 487484 | 12/1953 | Italy . | |
| 41378 | 9/1916 | Sweden . | |
| 144601 | 1/1931 | Switzerland . | |
| WO 94/25116 | 11/1994 | WIPO | 441/64 |

*Primary Examiner*—Ed L. Swinehart
*Attorney, Agent, or Firm*—Malloy & Malloy, P.A.

[57] ABSTRACT

An aquadynamic swim apparatus and method. A foil projects outwardly from a swimmer's lower leg, the foil having the shape of an airfoil and being adapted for a controlled angle of attack and rate of change thereof in response to forces applied by a swimmer's leg strokes. A second foil projects inwardly from the swimmer's lower leg, the foil being adapted for passive, limited inclination and declination.

22 Claims, 23 Drawing Sheets

10
12
11
16
160
17
18
22
14
20
13
15

AQUADYNAMIC SWIM APPARATUS

BACKGROUND OF THE INVENTION

This invention relates to a donnable apparatus for the aid of swimming, particularly such an apparatus employing advantageously the dynamics of water flow over and against surfaces thereof.

Simple donnable devices for the aid of swimming employ a semi-flexible swim member having a bluff surface that is attached to the foot for increasing the effective surface area thereof. The idea appears to be to increase the quantity of water to which a swimmer can impart backward kinetic energy and thereby achieve forward propulsion in a desired direction of swimming (hereinafter "swim direction"). The swim member moves substantially with the foot, so that the bluff surface is oriented by the foot to be oriented against the swim direction, during a thrust leg stroke, and along the swim direction, during a return leg stroke.

More complex devices for the aid of swimming typically employ a swim member attached to a leg or foot, the swim member including a body having a bluff surface. The body is hingedly attached to the swim member and rotates under the forces induced by swimming to present the bluff face to the swim direction during the thrust leg stroke and to retract or reorient the bluff face during the return leg stroke. These more complex devices appear to employ the same physical principle as do the aforementioned simple devices.

Each of these devices operates to provide additional surface area to a leg or foot, the surface area providing a means for a swimmer to exert additional force against the water than he or she could otherwise exert with a bare leg or foot.

There are primarily two disadvantages of these devices. First, such devices have not been found to provide desired improvements in swim speeds. Second, such devices have a limited capability for enhancing swimming efficiency. It is desirable to obtain maximum propulsion for minimum effort. While the aforementioned devices may provide a means for increasing the force a swimmer can apply to water, they apparently do not increase the propulsive effectiveness, or swim speed, for a given amount of applied force or swimmer effort.

Another disadvantage of many of these devices is the incorporation of a swim member or body having a moment arm with respect to the swimmer's leg, or foot, so that the force applied to the swim member tends objectionably to twist or bend it, the more so the greater the body's capability to provide propulsion. Prior art devices may impose serious bending stresses on the swimmer's ankles, especially during a return stroke during which the swimmer maintains toes in an extended and pointed configuration.

Moreover, it is advantageous for a swim apparatus to allow for normal walking without removal and, to various degrees, prior art swim devices do not provide this advantage.

Accordingly, there is a need for a novel method and apparatus for aquadynamic swimming so as to provide greater swim speed and efficiency, to provide reduced torque transmission to the swimmer's leg and to enable the swimmer to walk while the apparatus is being worn.

SUMMARY OF THE INVENTION

The aquadynamic swim apparatus of the present invention solves the aforementioned problems and meets the aforementioned needs by employing, on a swimmer swimming, a leg cuff having an outside foil pivotally connected to a first axle extending outwardly from the outside of the swimmer's leg proximate to the swimmer's ankle, the foil having a working position wherein a working surface of the foil lies substantially in the plane which divides the body into front and back halves (herein the coronal plane). The leg cuff further includes an inside foil pivotally connected to a second axle extending outwardly from the inside of the swimmer's leg proximate to the swimmer's ankle, the inside foil having a working surface which also lies substantially in the coronal plane, and a channeling member for apportioning water between the inside foil and the outside foil.

The outside foil and, preferably, the inside foil has substantially an airfoil profile in a plane parallel to the plane that substantially divides the body into left and right halves (herein the median plane), particularly a profile that resembles a transonic airfoil profile of high aspect ratio, wherein the profile is inverted from its normal orientation in an aircraft.

The outside foil includes an attitude control mechanism for changing the attitude thereof in response to the swimmer's leg strokes. In a preferred embodiment, the outside foil includes a hub which defines a center of rotation of the foil. The attitude control mechanism includes a control arm rigidly connected to the hub and extending substantially perpendicular to the foil surface when the foil is in its working position, and an extensible arm pivotally connected at a distal end thereof to the control arm and pivotally anchored at a proximal end thereof to the cuff at a location proximate the swimmer's knee. The extensible arm includes a slew rate and attitude adjustment mechanism which is preferably a piston and cylinder assembly that permits extension and contraction of the extensible arm in response to force applied to the foil by the swimmer's leg strokes. The piston and cylinder assembly includes means for controlling the rate at which a fluid, preferably water, may enter and exit the cylinder, for controlling the rate at which the foil may pivot about its axle in response to swimming strokes, so that the angle of attack of the foil may be positioned continuously and advantageously with respect to the progress of the swimmer's swim strokes.

The inside foil also, preferably, has the aforementioned airfoil profile. The inside foil includes articulation means for changing the attitude thereof in response to the swimmer's leg strokes. In a preferred embodiment, the articulation means includes a cap which is rigidly attached at the distal end of the second axle, the distal end of the axle extending beyond the outer side surface of the inside foil. The cap includes a stop arm which extends substantially parallel to the outer side surface of the foil. The articulation means also includes a fence plate attached to the outer side surface of the foil, the fence plate having a slot which receives the cap and stop arm and which is shaped so as to interfere with the stop arm at predetermined amounts of rotation of the inside foil.

The hub preferably includes stowing means for rotating the outside foil into the median plane and for folding the foil against the outside of the swimmer's leg in a stowage position, to facilitate walking with the apparatus.

Therefore, it is a principal object of the present invention to provide a novel and improved aquadynamic swim apparatus and method for use thereof.

It is another object of the present invention to provide such a swim apparatus and method that maximizes a swimmer's swimming speed.

It is a further object of the present invention to provide such a swim apparatus and method that maximizes the swimmer's swimming efficiency.

It is yet another object of the present invention to provide such a swim apparatus and method that minimizes torque reactions about the longitudinal axis of the swimmer's leg.

It is still another object of the present invention to provide such a swim apparatus and method that allows a swimmer to walk normally on land without removing the swim apparatus.

It is yet a further object of the present invention to provide such a swim apparatus and method that employs a swim member having an airfoil configuration.

It is still a further object of the present invention to provide such a swim apparatus and method that employs means for controlling the angle of attack of the swim member.

It is another object of the present invention to provide such a swim apparatus and method wherein the angle of attack of the swim member is controlled with respect to the angle of the swimmer's leg.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1:
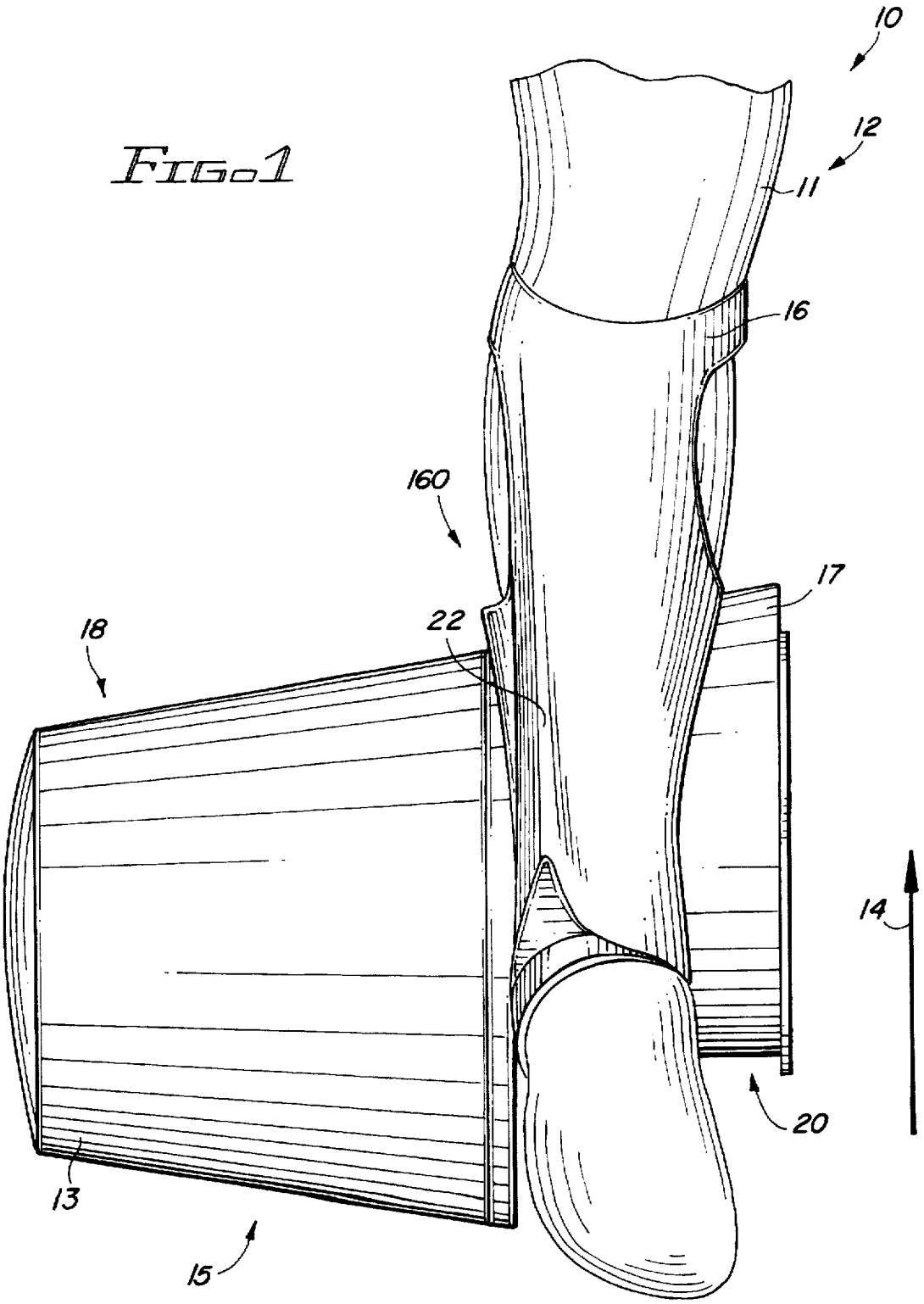
FIG. 1 is a plan view of an aquadynamic swim apparatus according to the present invention.

Referring to FIG. 1, a preferred embodiment of an aquadynamic swim apparatus 10 for use by a swimmer 12 swimming in a swim direction 14 includes a leg cuff 16 having an outside foil 18 extending outside the swimmer's leg 11 proximate the swimmer's ankle and having a working surface 13 disposed, when in a working position 15, to lie substantially in the coronal plane, an inside foil 20 extending inside the swimmer's leg having a working surface 17 also lying substantially in the coronal plane, and a channeling member 22 for apportioning water therebetween.

Figure 2:
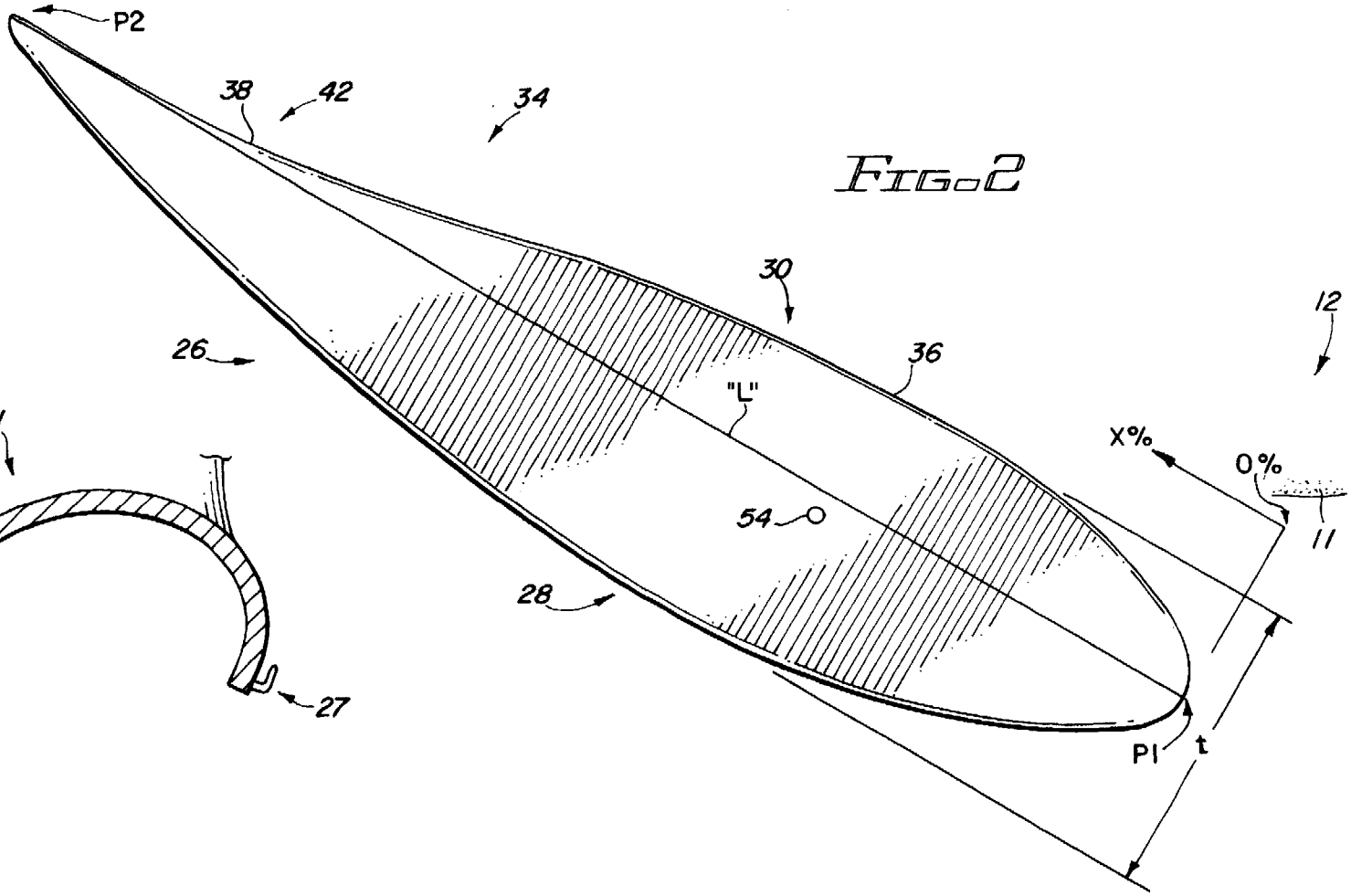
FIG. 2 is a side elevation of a profile of a foil according to the present invention.

Referring to FIG. 2, it has been found advantageous to employ in both the outside foil 18 and the inside foil 20 a profile 26 having a curvilinear shape, specifically, the shape of an airfoil as taken along a plane substantially perpendicular to the respective working surfaces 13, 17. Since water is an incompressible fluid, the dynamics of water flowing around the foils will not, generally, be governed by the laws of aerodynamics; nevertheless, enhanced swimming efficiency and speed have been achieved employing a profile 26 that, for illustrative purposes, can be seen to resemble an inverted version of what is known in the art of aerodynamics as a transonic airfoil profile. The profile 26 includes a convex bottom contour 28 and a top contour 30 joining the bottom contour at points "P1" and "P2". The contours 28 and 30 also form contours of the working surfaces 13, 17 of the foils 18, 20. A convex portion 36 of the top contour substantially smoothly joins a concave portion 38 thereof at a rearward half 34 of the profile 26, preferably at about a 75% position 42, with reference to the arrow labeled "X%". The aspect ratio of the profile 26, i.e., the ratio of its thickness "t" to its length "L", taken between the points "P1" and "P2", is preferably substantially about 0.2. Other aspect ratios, however, may be employed without departing from the principles of the invention. The inverted airfoil shape is believed to create a particularly advantageous pattern of vortices in the water during movement of the foil 18 therethrough during leg strokes, wherein vortices associated with the bottom contour 28 of the working surfaces 13 or 17 of the foils interact with vortices associated with the top contour 30 thereof so as to contribute unexpectedly to the swimmer's propulsion.

In particular, on a downward leg stroke a first, strong vortex develops in the forming low pressure area above and aft of the foil's trailing edge. This first, strong vortex follows the downward stroke and increases in magnitude until the downward stroke terminates. Similarly, on the upstroke, a second, counter rotating, weaker vortex develops below and aft of the foil's trailing edge, in a newly forming low pressure area. As the new low pressure area forms, however, the first, strong vortex moves aggressively towards it causing the two vortexes to meet. Upon meeting, the first strong vortex pushes the second, counter rotating, weaker vortex away, generating a jet of thrust against the foil on the upstroke. Moreover, as the vortexes attempt to move towards the weaker low pressure area, vortex drag on the swimmer is terminated, and indeed, any vortex drag that is generated by the swimmer's body is absorbed by the larger first and second vortexes generated by the foil strokes. Such a termination and/or reduction of drag is seen to enhance the energy of the swimmer's strokes.

Figure 4B:
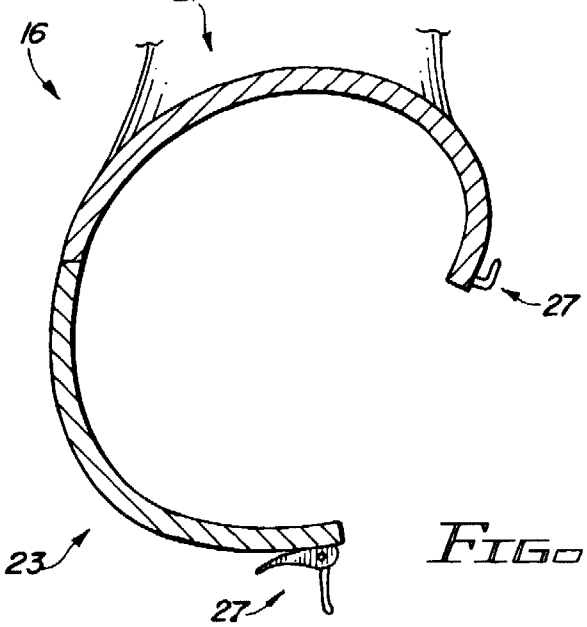
FIG. 4B is a cross-section of the swim apparatus of FIG. 4A, taken along line 4B—4B thereof.
Figure 3:
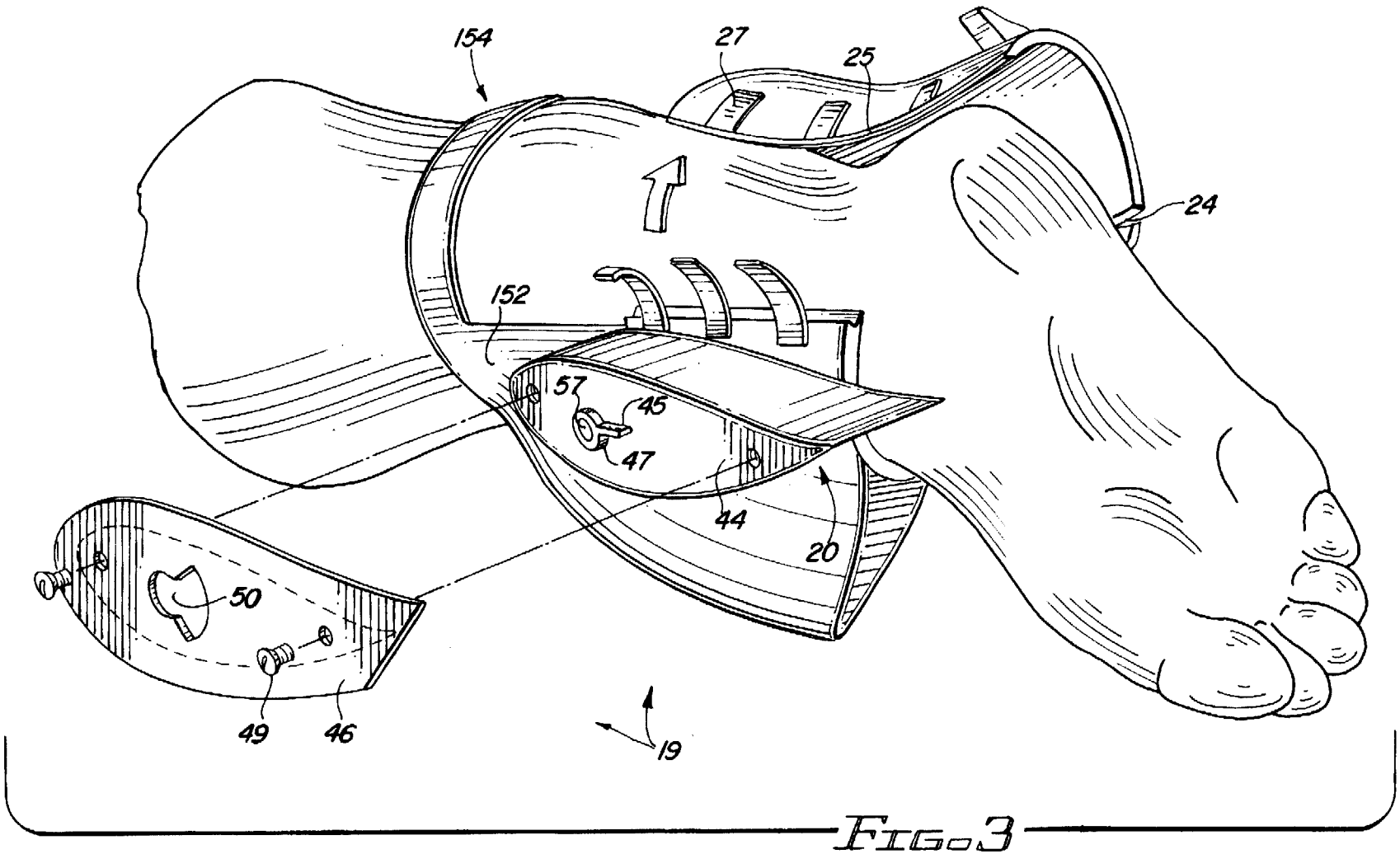
FIG. 3 is a pictorial view of a leg cuff and inside foil aspect of the swim apparatus of FIG. 1, according to the present invention.
Figure 4A:
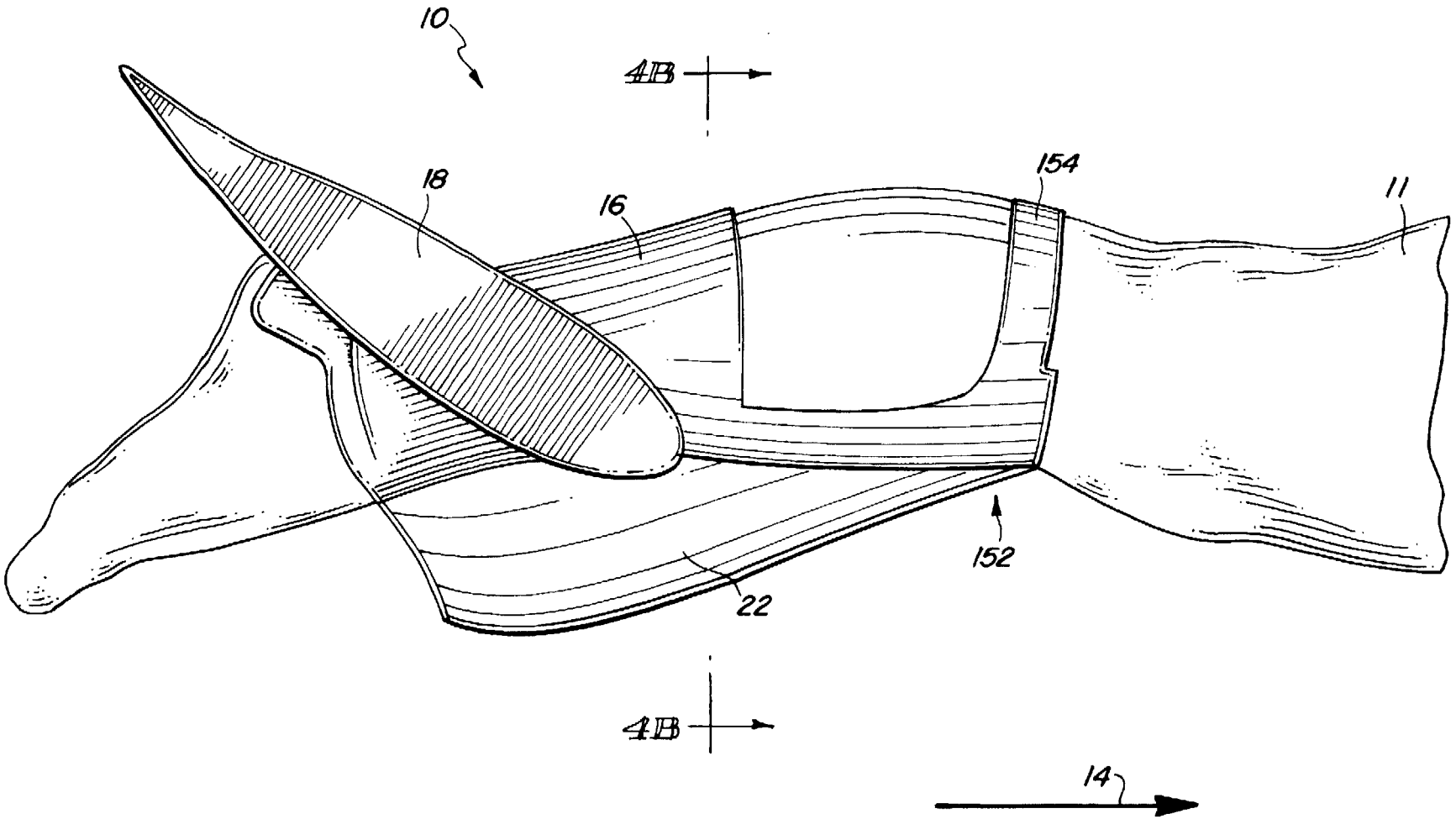
FIG. 4A is a side elevation of the swim apparatus of FIG. 1.

Referring to FIGS. 3, 4A and 4B, the leg cuff 16 preferably encircles the lower leg from the top of the instep to substantially about six inches up the leg therefrom and includes substantially about a one-eighth inch thickness of an elastomeric lining material, such as neoprene. The cuff 16 also provides, preferably, substantially about one-eighth of an inch of space between the lining material and the swimmer's leg, for accepting a one-eighth inch thickness wet-suit underneath, to provide for the swimmer's comfort. Alternatively, the cuff may be adapted for use with any other thickness of wet-suit, or no wet-suit at all.

The cuff 16 includes a hinge 24 and substantially diametrically opposed longitudinal slit 25, the hinge for opening the cuff for placing it around the leg 11, and the slit including fastening members 27, for example hook and loop fasteners, for closing and securing the cuff around the leg. Preferably a top portion 21 of the cuff is formed of a relatively rigid material, preferably a composite plastic material, in order to provide a structure upon which to mount elements to be introduced below. Preferably as well, a bottom portion 23 of the cuff is formed of a flexible plastic material, to provide for the function of the hinge 24. The top and bottom portions are preferably formed integrally of the same plastic matrix, differences in flexibility being obtained by selectively adding composite materials and by adjusting thicknesses as will be readily appreciated by those of ordinary skill.

The cuff 16 preferably also includes an upper leg harness 152 which includes a strap 154 and fastening mechanism, such as a hook and loop fastener (not shown). The upper leg harness stabilizes the apparatus 10.

Figure 5:
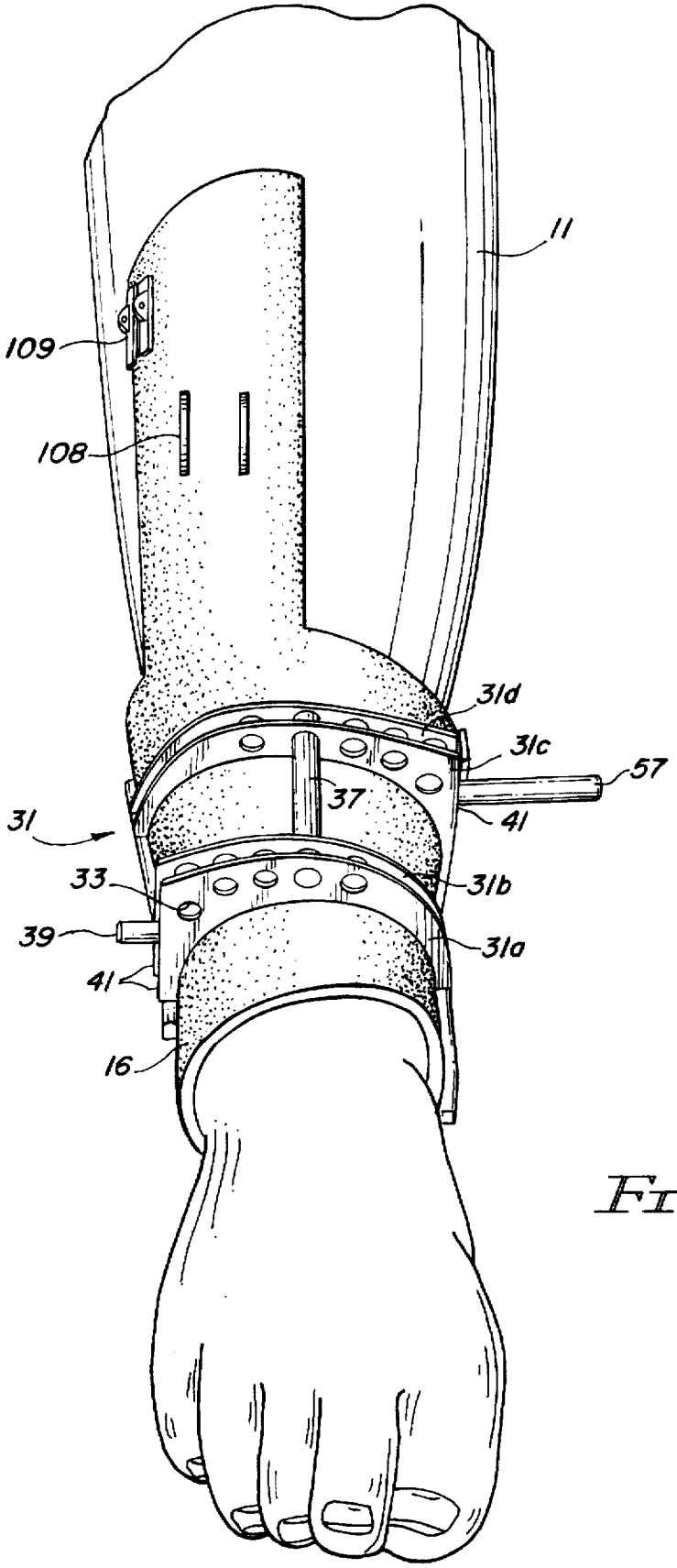
FIG. 5 is a pictorial view of a structural member and first and second axle aspect of the swim apparatus of FIG. 1, according to the present invention.

Referring to FIG. 5, the cuff 16 includes a plurality of spaced apart, radially projecting structural members 31. The structural members conform to the surface of the leg cuff, and therefore substantially to the shape of the swimmer's leg and, preferably, include weight reducing apertures 33 located at or near the centroidal axis of the structural members. The structural members 31 are further tied together by a torque transmitting member 37 which is preferably a tube extending through and bonded to each of the structural members. The structural members 31 may be stainless steel and the bonding achieved by welding. The structural members may also be formed of a composite plastic material and the bonding achieved by adhesive. Preferably, the structural members, the torque member 37 and the cuff 16 are formed integrally of the composite plastic material.

Among the structural members 31 are two structural members 31 a and **31*b* which support, therebetween, a rigidly connected and radially projecting first axle 39, the first axle lying substantially in the swimmer's coronal plane and extending outside of the swimmer's leg. The first axle 39 is bonded to or formed integrally with the two structural members 31*a* and 31*b*, and may be metal or plastic. Preferably, the axle 39 and the structural members 31*a*, 31*b*** are integrally formed of composite plastic material.

Figure 6:
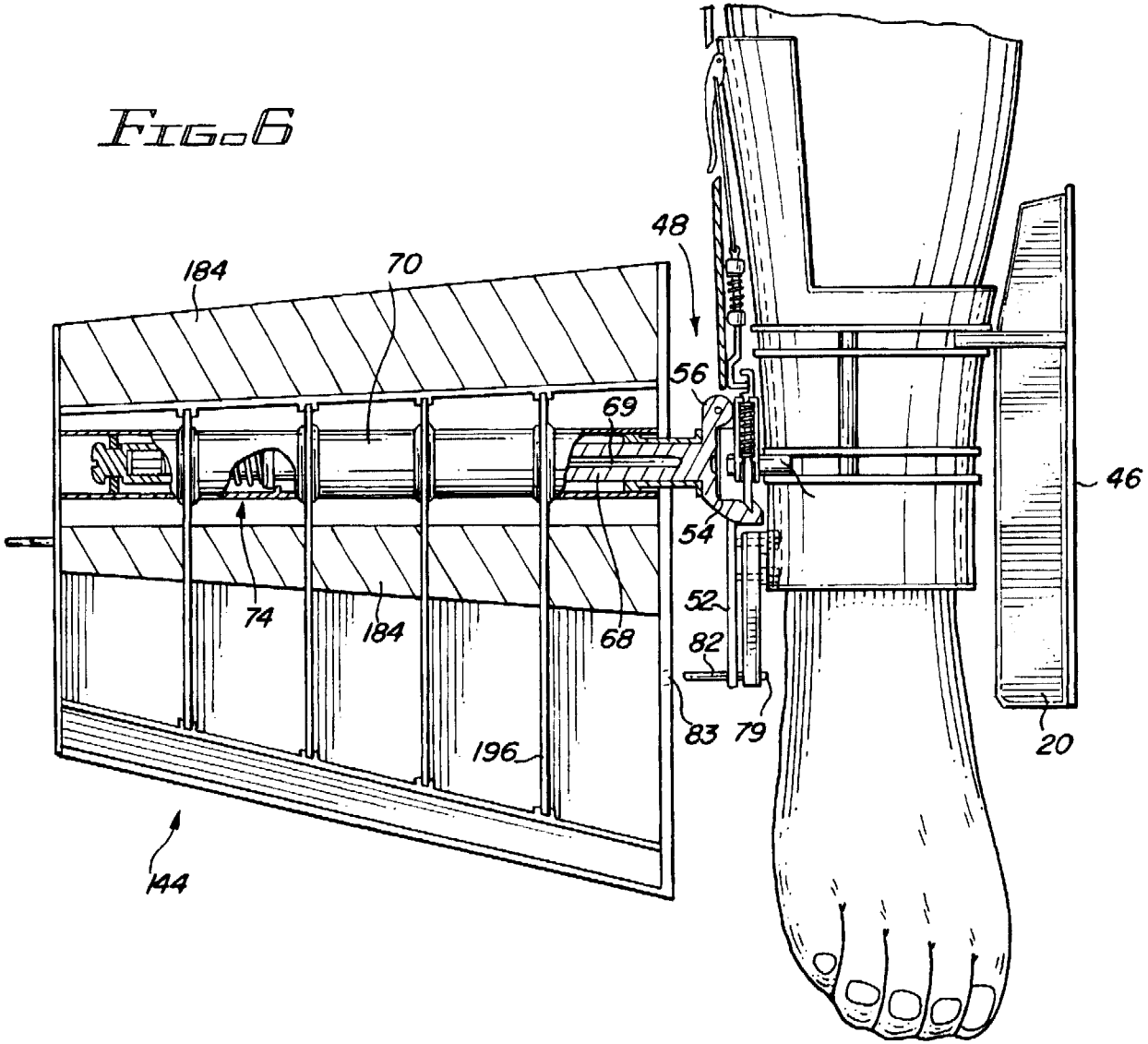
FIG. 6 is a first plan view of internal aspects of the swim apparatus of FIG. 1, showing an outside foil according to the present invention pulled out from a working position in anticipation of stowage.
Figure 7:
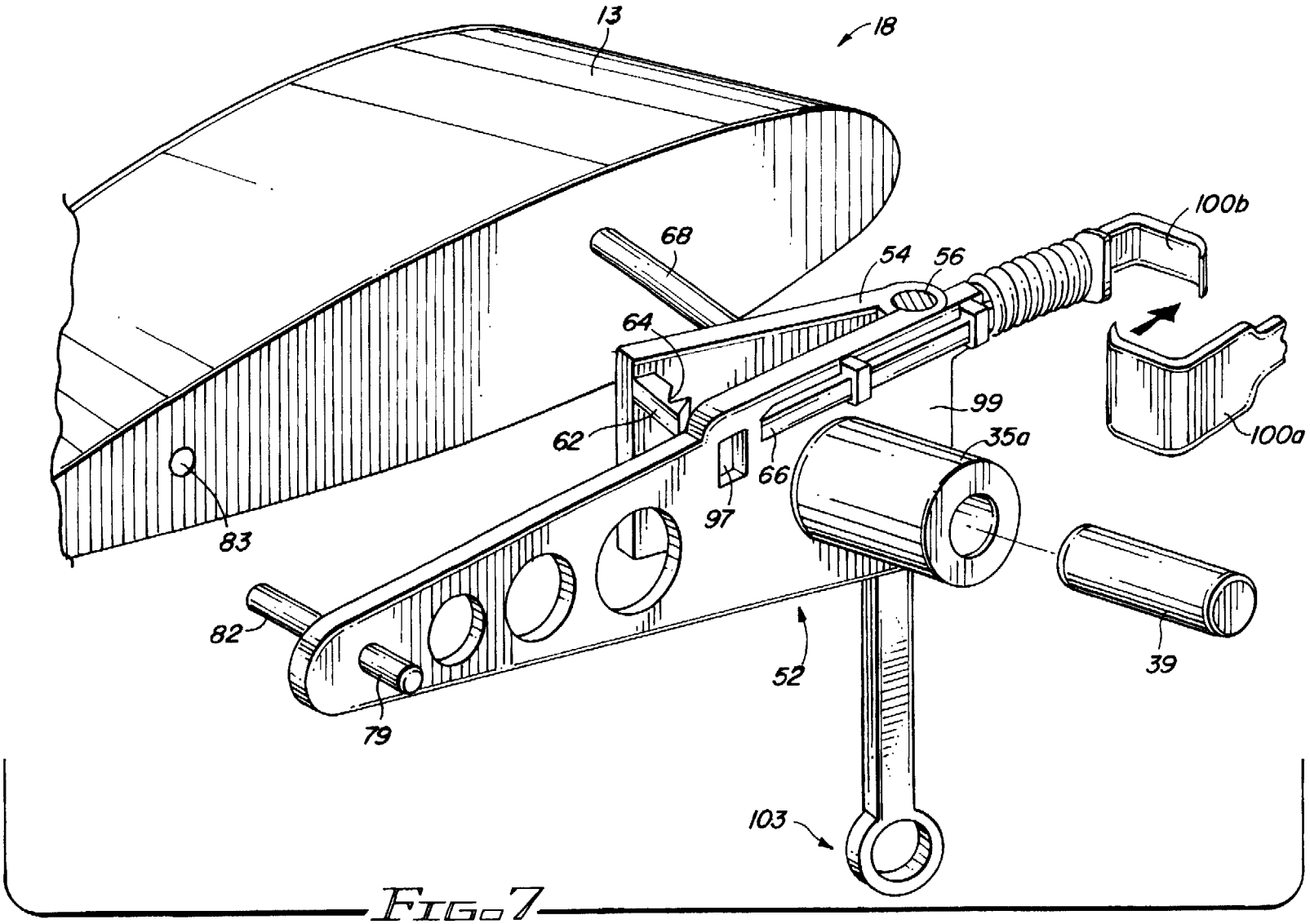
FIG. 7 is a pictorial view of a hub aspect of the apparatus of FIG. 1, according to the present invention.
Figure 8A:
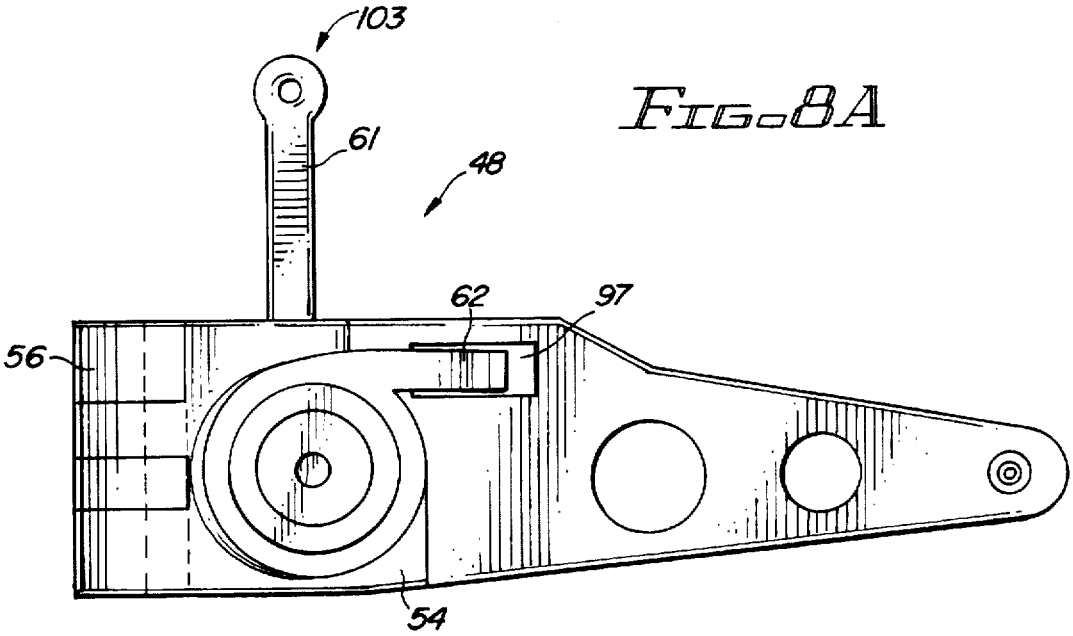
FIG. 8A is a side elevation of the hub of FIG. 7.
Figure 8B:
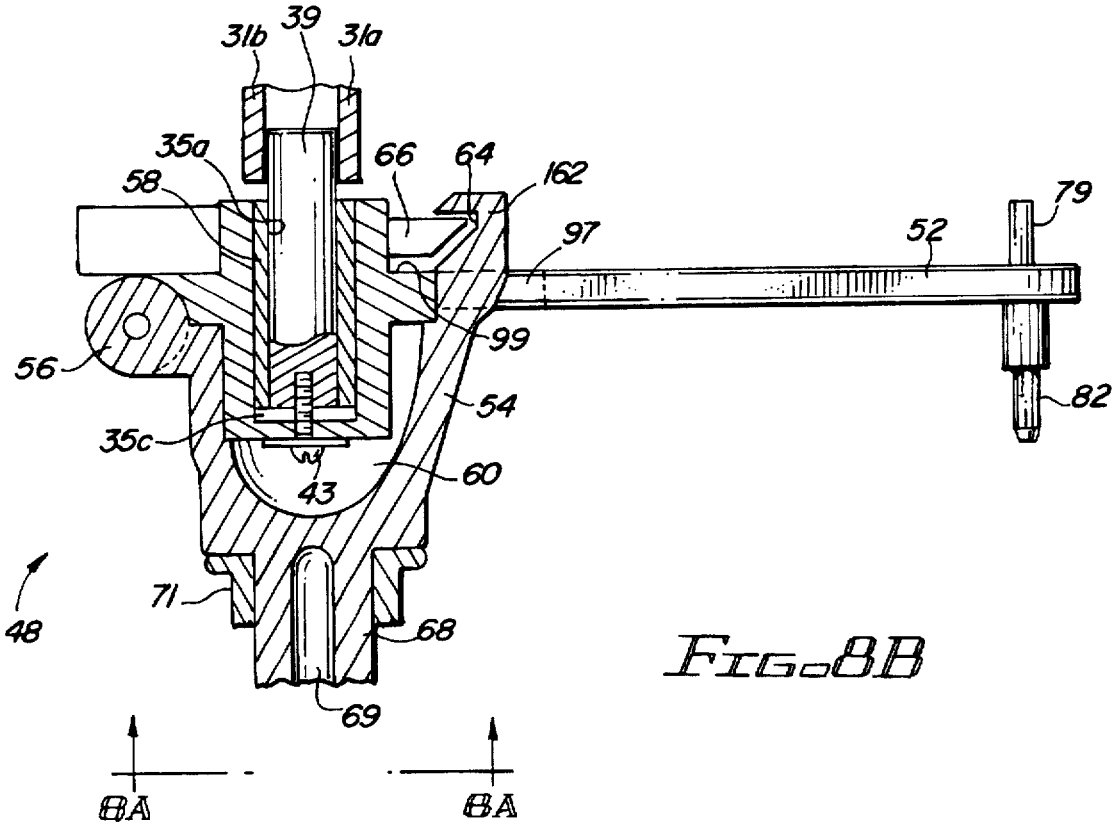
FIG. 8B is a top view of the hub of FIG. 8A, taken along a line 8A—8A thereof

Referring to FIGS. 5, 6 and 7, the first axle 39 extends beyond outer edges 41 of the structural members **31*a* and 31*b* a distance sufficient to support a bearing 35*a* of a rotatably connected hub 48. Referring to FIG. 8B, the axle 39 is internally threaded to receive a retaining screw 43 which passes through the hub 48 and end bearing 35*c*** thereinto and retains the hub to the axle while controlling end-play.

The structural members also include two structural members **31*c* and 31*d* which support, therebetween, a rigidly connected and radially projecting second axle 57, the second axle lying substantially in the swimmer's coronal plane and extending inside of the swimmer's leg. The second axle 57 is bonded to or formed integrally with the two structural members 31*c* and 31*d*, and may be metal or plastic. Preferably, the axle 57 and the structural members 31*c*, 31*d*** are integrally formed of composite plastic material.

Referring again to FIG. 3, the inside foil is attached to the apparatus 10 through an articulation means 19. The articulation means 19 includes a cap 47 which is rigidly attached to the distal end of the second axle 57, the distal end of the axle extending beyond an outer side surface 44 of the inside foil 20. The cap retains the inside foil on the second axle 57. Accordingly, axle 57 is preferably internally threaded and the cap preferably has a threaded shank (not shown) for mating attachment therewith, the cap 57 capturing a bearing 35*b* (also not shown) for surrounding the axle.

The cap 47 includes a stop arm 45 attached thereto, the stop arm extending substantially parallel to the side surface 44 of the foil. The means 19 also includes a fence plate 46 attached to the side surface 44, preferably with screws 49, the fence plate having a slot 50 which receives the cap 47 and stop arm 45 and which is shaped so as to interfere with the stop arm at predetermined amounts of rotation of the inside foil. Other means well known in the art of limiting rotation of the foil 20 may also be employed without departing from the principles of the invention.

In addition to providing the aforedescribed function, the fence plate 46 provides for retaining water over the working surface 17 of the inside foil 20. Accordingly, the fence plate extends from and is substantially perpendicular to the working surface 17. Preferably, the fence plate is substantially flat and has a profile that substantially follows the shape and size of the side surface 44 of the foil 20.

Referring to FIGS. 6, 7, 8A and 8B, the hub 48 includes an inner leaf 52 hingedly connected to an outer leaf 54 at a hinge 56 disposed proximal to the axle 39, the hinge 56 having a hinge axis lying substantially in the swimmer's median plane. The inner leaf includes an aperture 58 for matingly receiving, for example, by friction fit, the bearing 35*a*. Thence, the inner leaf 52 is permitted to rotate about the first axle 39.

The outer leaf 54 may include a cavity 60 to provide clearance for the axle 39 and the retaining screw 43 when the outer leaf 54 is folded against the inner leaf 52.

An outside foil axle 68 is rigidly connected to the outer leaf 54 so that, when the hinge 56 is in a closed configuration, the outside foil axle is substantially co-linear with the first axle 39. Preferably, the outside foil axle 68 and the outer leaf 54 are formed integrally of a composite plastic material. Especially if the outside foil axle is formed of stainless steel, it is preferable to include an internal hollow 69 for lightening thereof. A compliant seating member 71 is preferably employed around the axle 68 for seating the outside foil 18 against the outer leaf 54.

Figure 9:
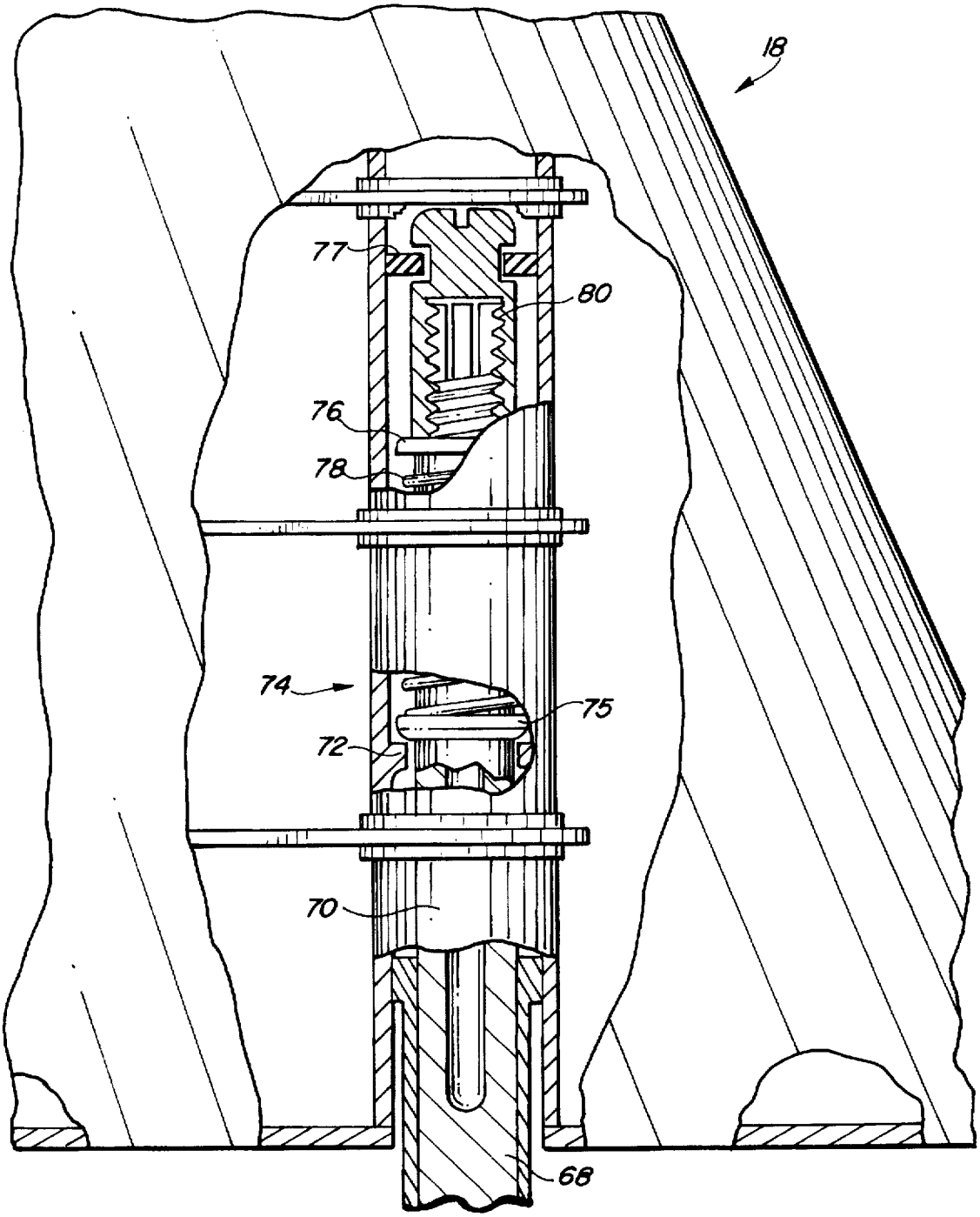
FIG. 9 is a partially cut-away view of an outside foil and spring biasing mechanism according to the present invention.

Referring to FIG. 9 and again to FIG. 6, the outside foil 18 includes a skeleton 144 which carries internally and is rigidly connected to an axle housing 70 which fits around the foil axle 68 to permit rotation of the foil 18 with respect thereto. The axle housing 70 includes a ledge 72 for engaging a spring biasing mechanism 74 connected to the foil axle 68. A spring biasing mechanism 74 includes a proximal spring cup 75, a distal spring cup 76 and a coil compression spring 78 situated therebetween. The spring cups 75, 76 and the spring 78 surround the foil axle 68, and the proximal cup 75 and the spring are permitted to move relative thereto, while the distal cup 76 is fixed with respect to the foil axle 68 by a retainer cap 80. Thence, a force applied to the proximal cup 75 tending to displace it toward the distal cup 76 will cause the proximal cup 75 to move outwardly along the foil axle 68 against the force of the compression spring 78. Such a force is applied by the ledge 72 of the axle housing 70 when the outside foil 18 is pulled outwardly. Thence, the spring 78 tends to bias the outside foil 18 toward the swimmer's leg. A shock absorbing member, such as "O" ring 77, is employed between the retainer cap 80 and the axle housing 70, for absorbing shock encountered by the outside foil 18.

Referring again to FIGS. 7 and 8B, a foil pin 82 is provided for engaging the foil 18 when the foil is in its working position 15. The spring 78 biases the foil thereagainst as aforedescribed. The foil pin 82 extends substantially parallel to the axle 39 and depends from the inner leaf 52. The pin 82 mates with an aperture 83 in the foil 18 to lock the foil in the working position.

The outer leaf 54 includes a latch arm 62 having a re-entrant latch portion 64 adapted to receive a spring biased latch pin 66 disposed along an inner surface 99 of the inner leaf 52. The latch portion 64 reaches the latch pin 66 through a latch aperture 97 in the inner leaf 54. The latch arm and latch pin are employed for latching the foil 18 in its working position as will be described more fully in OPERATION, below.

Figure 12:
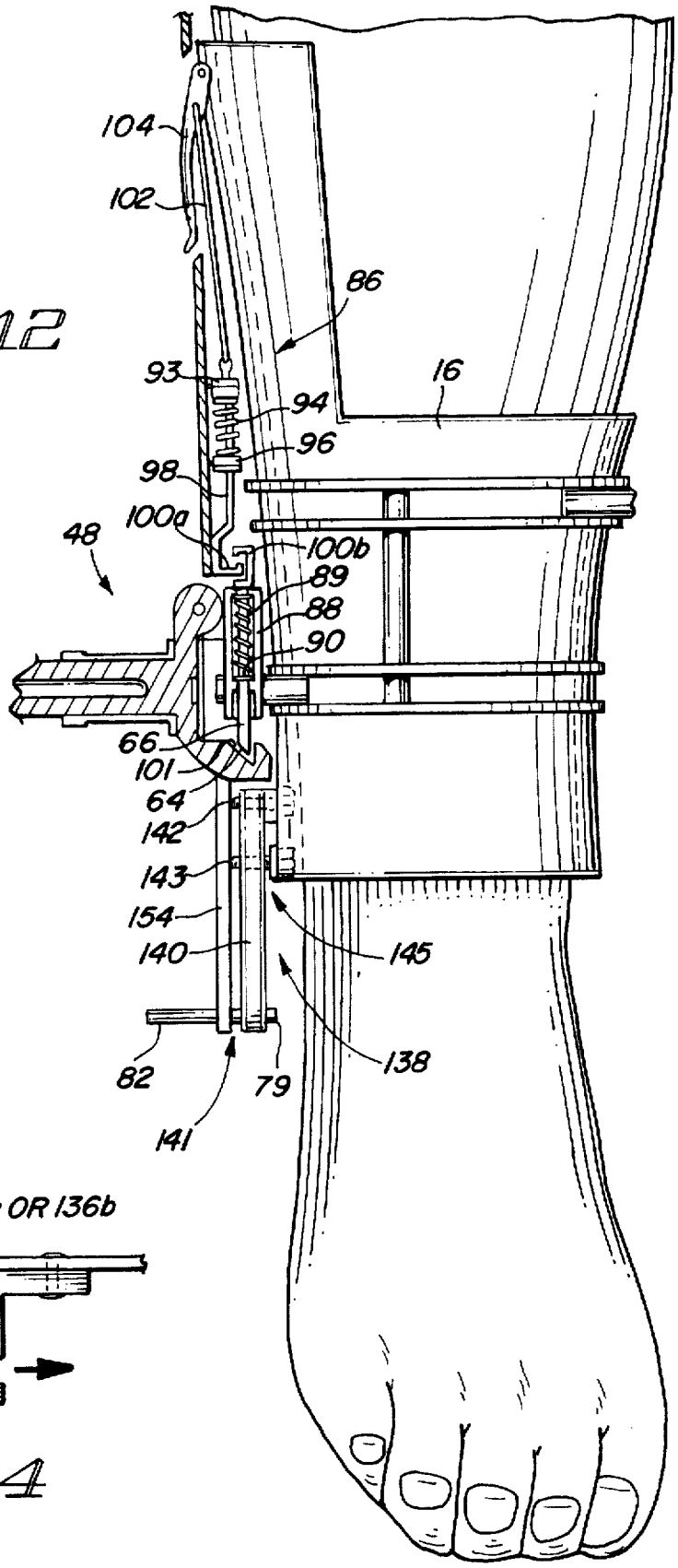
FIG. 12 is a plan view of the apparatus of FIG. 6 with the outside foil partially cut-away.

Referring to FIG. 12 and again to FIG. 7, the latch pin 66 is preferably an elongate member slidably captured by the inner surface 99 of the inner leaf 52 and has a point 101 which mates with the re-entrant portion 64 of the latch arm 62.

The latch pin 66 is adapted to be remotely operated by the swimmer. The latch pin 66 is mounted in a pin body 88 which slidably receives the pin and a first compression spring 89 which biases the pin toward the latch portion 64 of the hub 48 by acting between the pin body 88 and a first ledge 90 of the pin 66.

A remote assembly 86 communicates with the latch pin 66 and includes a remote body 93 which may be attached to the cuff 16 or to external surfaces of the apparatus 10 which are described below. The remote body 93 houses a second compression spring 94 and secures one end thereof, the other end of the spring 94 acting against a second ledge 96 to bias a remote rod 98 toward the pin body 88. A remote rod 98 communicates at a first end thereof with an end of the pin 66 via hooks 100*a*, 100*b* attached respectively to the remote rod and to the pin 66, the hooks permitting the communication of tensile force, for pulling the pin 66 away from the latch portion 64 and thereby permitting the aforedescribed opening of the hinge 56.

The remote rod 98 is preferably operated by the swimmer via an operating rod 102 connected to a second end of the remote rod, the operating rod being operated via an operating lever 104 attached to the cuff 16. The operating rod 102 experiences only tension and may, alternatively, be formed of a cable or chain. The operating lever is attached to a bracket 109 on the cuff 16 (see FIG. 5).

Figure 13:
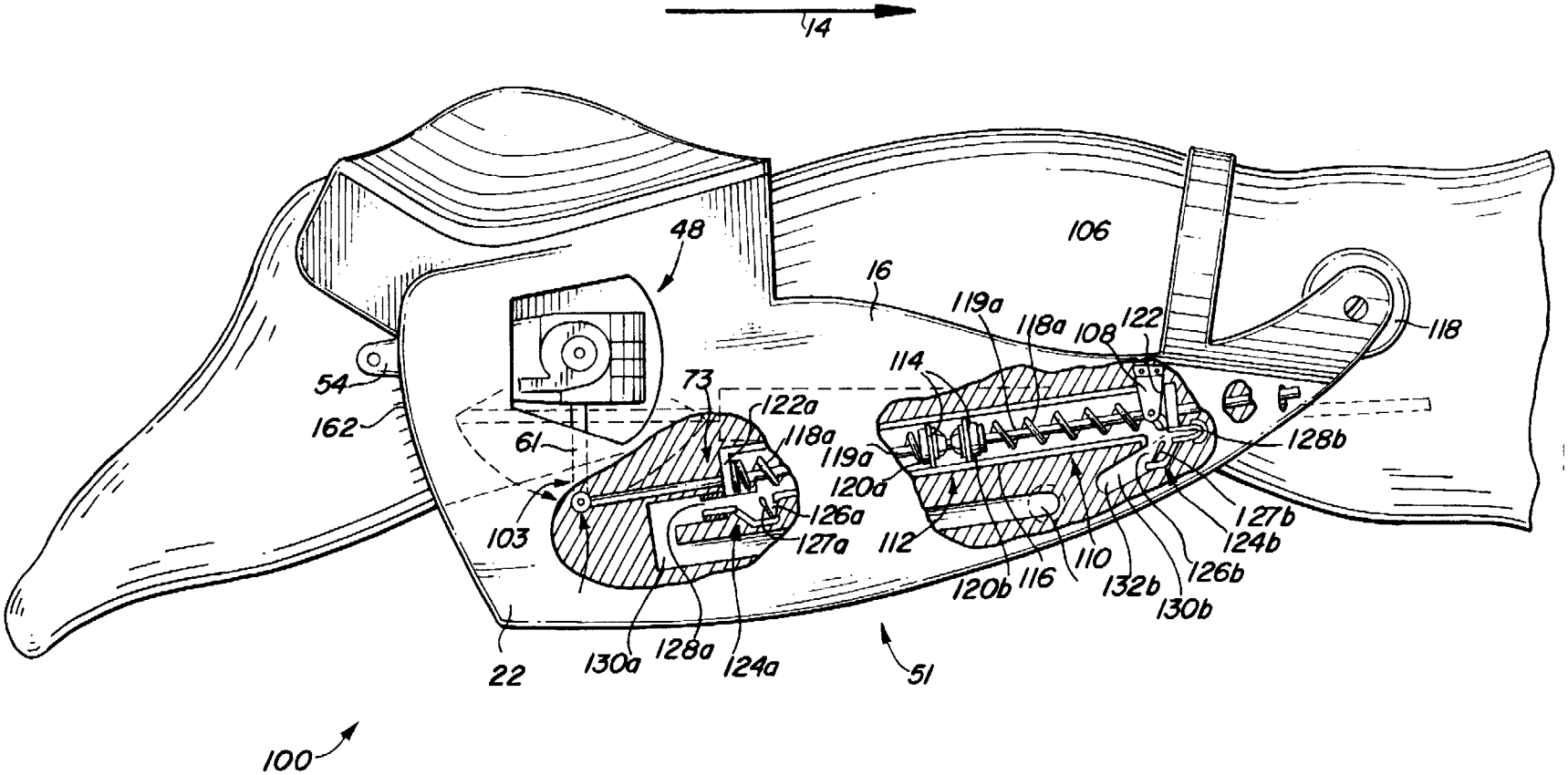
FIG. 13 is a partially cut-away pictorial view of the swim apparatus of FIG. 1 with the outside foil of FIG. 6 removed.

Referring to FIG. 13 and again to FIG. 7, the apparatus 10 includes an attitude control mechanism 51. The attitude control mechanism includes a control arm 61 projecting radially from the hub 48, substantially in the median plane and substantially perpendicular to the orientation of the working surface 13 of the foil 18. The control arm includes a distal end 103 to which is pivotally attached a distal end 105 of an extensible arm 73 of the control mechanism 51. The extensible arm is anchored at a proximal end 106 thereof to the cuff 16 at a bracket 108 located proximate to the swimmer's knee. The control arm 61 provides for control, through the extensible arm, of the attitude of the outside foil 18.

The extensible arm 73 includes a slew rate and attitude adjustment mechanism 110 which controls the rate that the foil 18 may rotate about the axle 39 in response to swimming forces applied to the foil 18 by the swimmer's leg strokes.

The mechanism 110 preferably includes a piston and cylinder assembly 112 which permits extension and contraction of the extensible arm 73 in response to the swimming forces.

The piston and cylinder assembly 112 includes a double-headed piston 114 in a cylinder 116 pivotally mounted to a bracket 108 attached the cuff 16. The piston makes a substantially water-tight seal with the cylinder. The piston 114 includes opposed outwardly extending rods 119*a* and 119*b* wherein the rod 119*a* forms one end of the extensible arm 73 and the rod 119*b* is free floating. Compression springs 118*a*, 118*b* surround the respective rods and exert force against respective back surfaces 120*a*, 120*b* of the piston 114 and between respective ends 122*a*, 122*b* of the cylinder 116. The springs 118*a*, 188*b*, are adapted so as to tend to restore the piston 114 to a substantially medial position within the cylinder. Thence, the assembly 112 biases the extensible arm 73 into a configuration of median length.

Each end 122*a*, 122*b* includes a port 124*a*, 124*b* for permitting a working fluid, preferably water, to enter and exit the cylinder. Each port includes an inlet 126*a*, 126*b* respectively. The inlets are in fluid communication with a fluid source which is, preferably, the water in which the swimmer swims. The inlets include respective check valves 127*a*, 127*b* for permitting the fluid to enter the cylinder thereat but not to leave it. Each port also includes an outlet 128*a*, 128*b* respectively. The outlets are in fluid communication with the fluid source, preferably via flexible tubes 130*a*, 130*b* respectively. Preferably as well, the tubes 130*a*, 130*b* include respective means 132*a*, 132*b* for controlling the rate at which the fluid may enter and exit the cylinder, for controlling the rate at which the foil may pivot about its axle in response to swimming strokes, so that the angle or attack of the foil may be positioned continuously and advantageously with respect to the progress of the swimmer's swim strokes.

Figure 14:
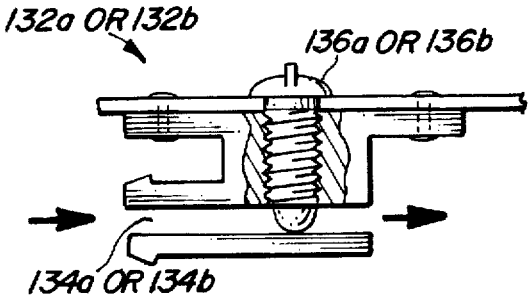
FIG. 14 is a side elevation of a means for controlling the rate at which fluid may enter a cylinder according to the present invention.

Referring to FIG. 14, the means 132*a*, 132*b* include respective chambers 134*a*, 134*b* which are in fluid communication with the associated flexible tubes 130*a*, 130*b*. The chambers 134*a*, 134*b* form a pathway through which the fluid may exhaust through respective tubes. The chambers include respective valves 136*a*, 136*b*, preferably screws threaded into the chamber disposed so as to block the chamber to an adjustable extent. Adjusting the valves 136*a*, 136*b* provides for adjusting the resistance of the slew rate and attitude control mechanism 110 to the expulsion of the fluid from the cylinder 116.

The slew rate and attitude control mechanism 110 allows the hub 48 to rotate at a controlled rate either clockwise or counterclockwise, the rate being timed to relate to the swimmer's stroke speed, for achieving an attitude or angle of attack that is adjusted for leg angle. The slew rate and attitude control mechanism is also adapted to optimally limit the amount of clockwise and counterclockwise rotation, through the travel of the pistons 114*a*, 114*b*. In particular, the piston and cylinder assembly 112 can be adapted for different lengths of travel of the piston 114 and, therefore, can effect a different attitude limitation for thrust and return leg strokes. It has been found to be preferable, however, for both of these attitude limitations to be substantially about 25 degrees. Similarly, different settings of the valves 136*a* and 136*b* can allow for different rates of rotation in the clockwise and counterclockwise directions.

Figure 15A:
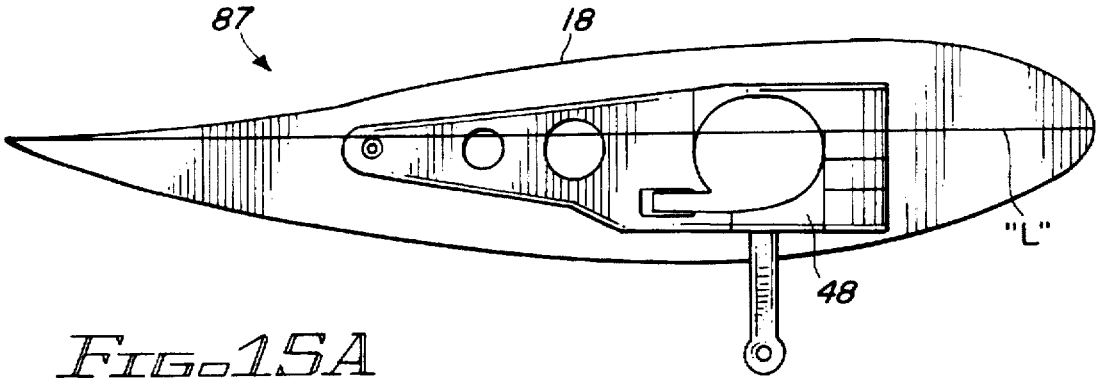
FIG. 15A is a side elevation of the profile of FIG. 2 and the hub of FIG. 8A having a substantially zero degree angle of attack.

The extensible arm 73 and the slew rate and attitude control mechanism 110 are adapted to maintain the hub 48 at a predetermined first component angular orientation. Referring to FIG. 15A, the foil 18, when latched into its working position, is maintained at a predetermined second component angular orientation with respect to the hub. The sum of the first and second component angular orientations is a resultant angular orientation 87 wherein the foil has, preferably, substantially zero attitude, or is neutral, with respect to the elongate axis of the swimmer's lower leg when no forces are being applied to the foil. The axis of the foil which provides for measuring this angle is determined by the aforedescribed line "L". Thence, when the hub 48 is oriented so that the orientation 87 is substantially aligned with the elongate axis of the swimmer's lower leg, the foil is referred to herein as being in a neutral attitude, or as having a zero degree angle of attack.

Figure 15B:
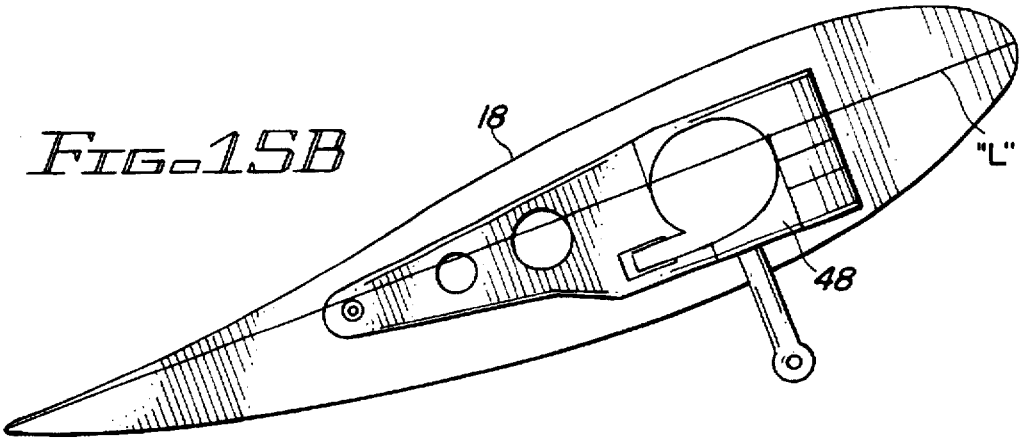
FIG. 15B is a side elevation of the profile and hub of FIG. 15A having a positive angle of attack.
Figure 15C:
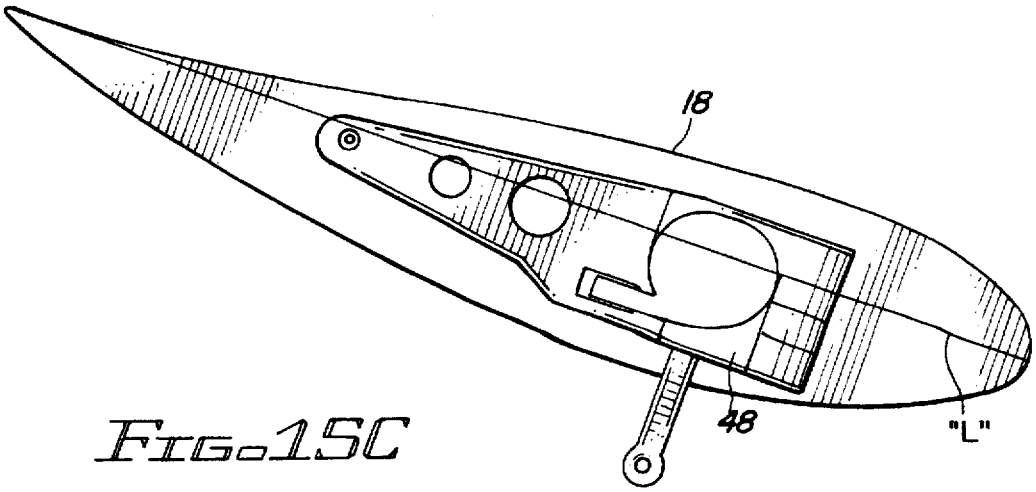
FIG. 15C is a side elevation of the profile and hub of FIG. 15A having a negative angle of attack.

Referring to FIG. 15B, inclinations of the foil, as would occur during the swimmer's return stroke, are referred to herein as having positive angles of attack. Referring to FIG. 15C, declinations of the foil, as would occur during the swimmer's thrust stroke, are referred to herein as having negative angles of attack. The aforementioned orientational definitions apply herein to the inside foil 20 as well.

Figure 16:
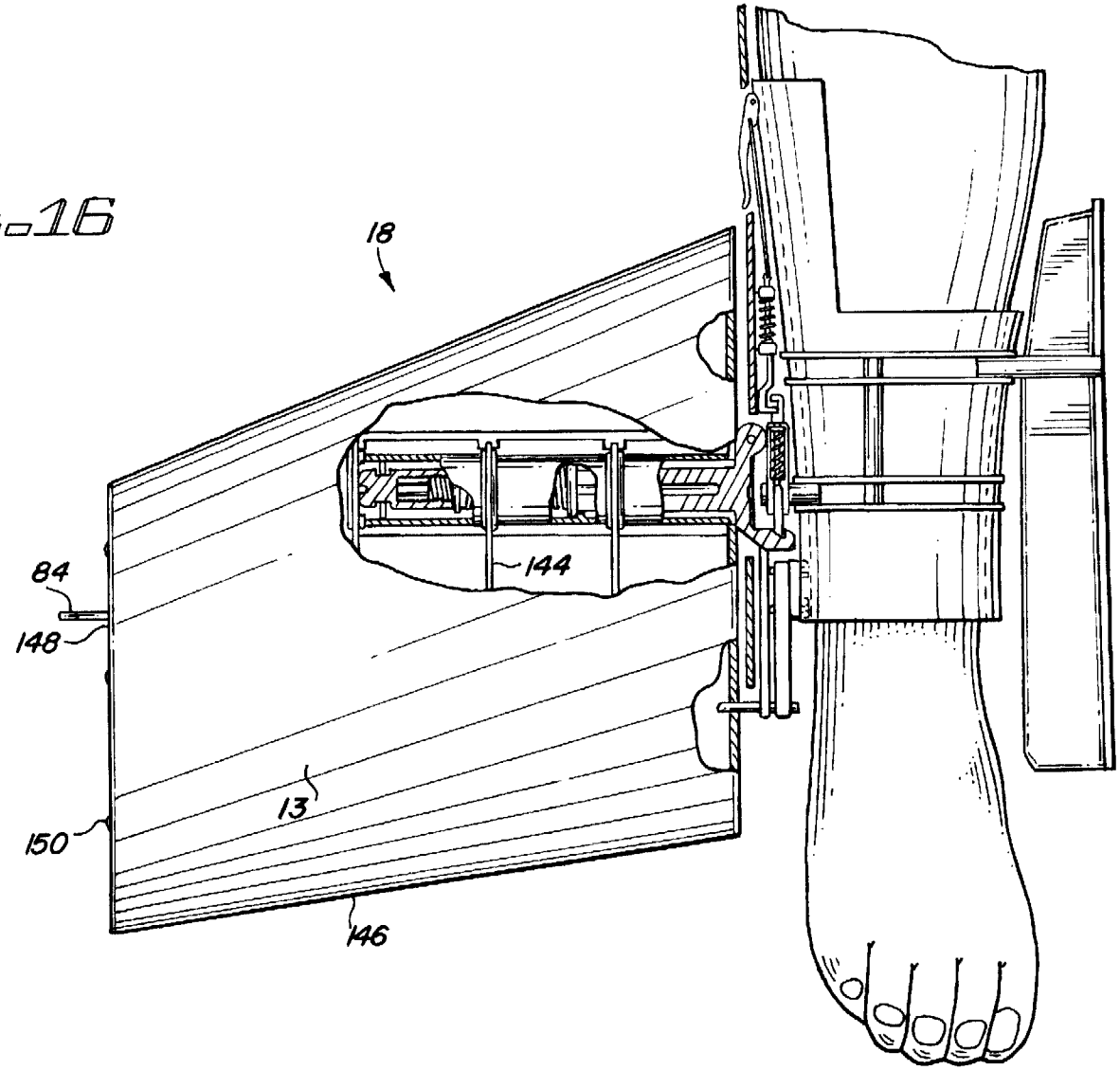
FIG. 16 is a partially cut-away top view of the swim apparatus of FIG. 1.

Referring to FIG. 16, the outside foil 18 includes a foil cover 146, which slides over and is fastened to the foil skeleton 144. The foil cover 146 includes the working surface 13 of the foil 18. The foil cover 146 includes an aperture 148 for passing through the hook 84, and may be secured to the foil skeleton by screws 150.

Referring again to FIG. 12, a delay mechanism 138 employs a leaf spring 140 attached at a pivot point 142 to the cuff 16 and extends therealong substantially parallel to the outer leaf 154 of the hub 48. A stop 143 is also attached to the cuff disposed so as to contact the spring 140 at a mid-position thereof. A distal end 141 of the spring 140 contacts, during selected portions of the swimming stroke, a delay spring pin 79 which extends from the foil pin 82 as will be described more fully below in OPERATION.

Figure 17A:
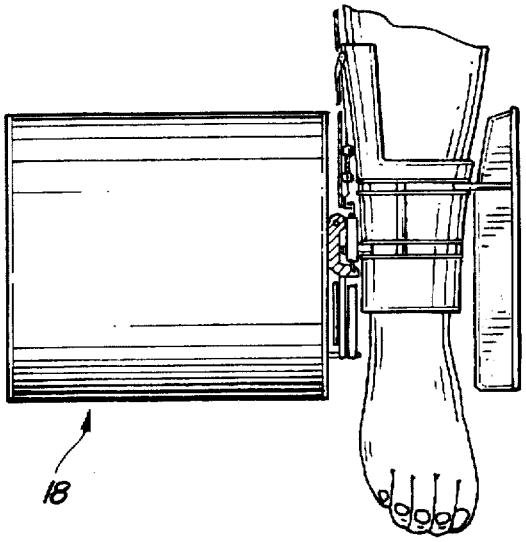
FIG. 17A is a top view of the outside foil of FIG. 6 in a straight configuration.
Figure 17B:
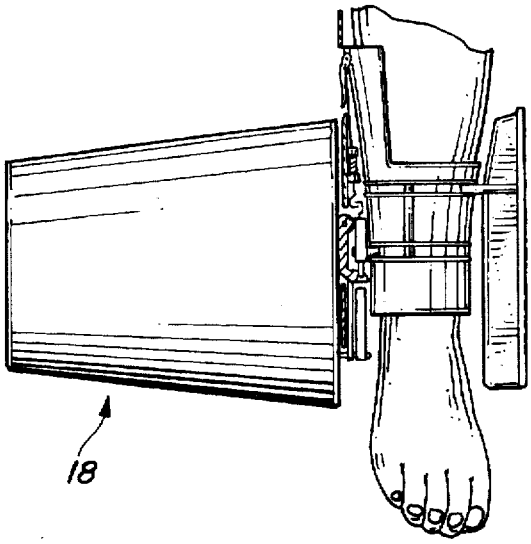
FIG. 17B is a top view of the outside foil of FIG. 6 in a tapered configuration.
Figure 17C:
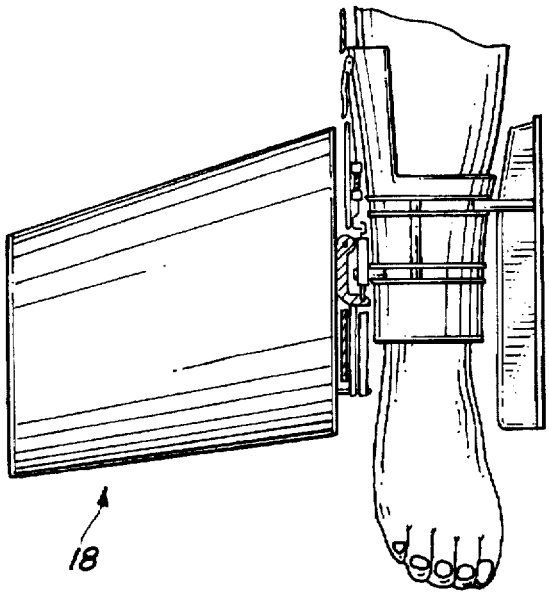
FIG. 17C is a top view of the outside foil of FIG. 6 in a swept configuration.

The axles 39 and 57 are each positioned within and are substantially perpendicular to the profile 26 of their respective foils 18 and 20 at substantially about a 30% position 54 (see FIG. 2). This provides for substantially 70% of the surface area of the foils 18 and 20 to be disposed rearwardly of their associated axles 64 and 47. The precise location, on the profile 26, of the connection of the axles 39 and 57 to their associated foils 18 and 20 depends, inter alia, on the particular geometry of the foils, e.g., whether the foils are "straight" as depicted in FIG. 17A, "tapered" as depicted in FIG. 17B, or "swept" as depicted in FIG. 17C. The foils 18 and 20 may have any of these configurations and may include aspects of any of these configurations in combination.

Figure 18A:
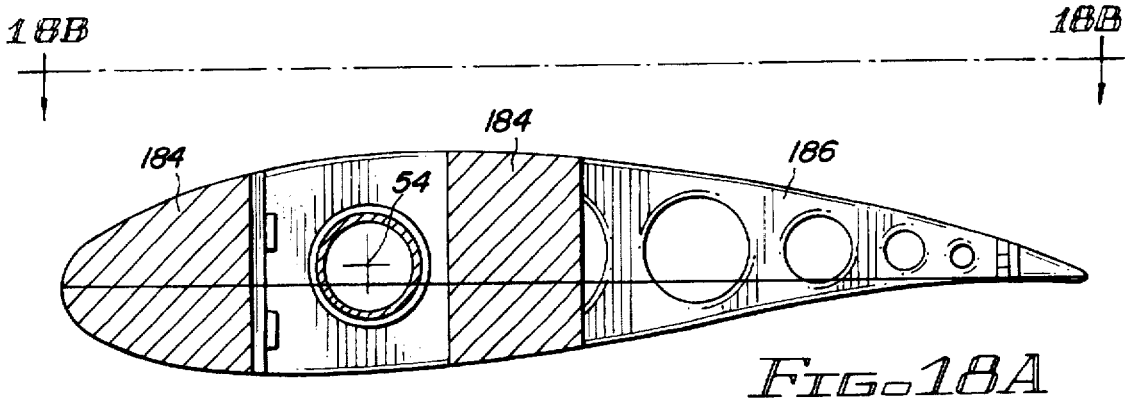
FIG. 18A is a side elevation of the outside foil of FIG. 6 showing a distribution of foam thereinside.
Figure 18B:
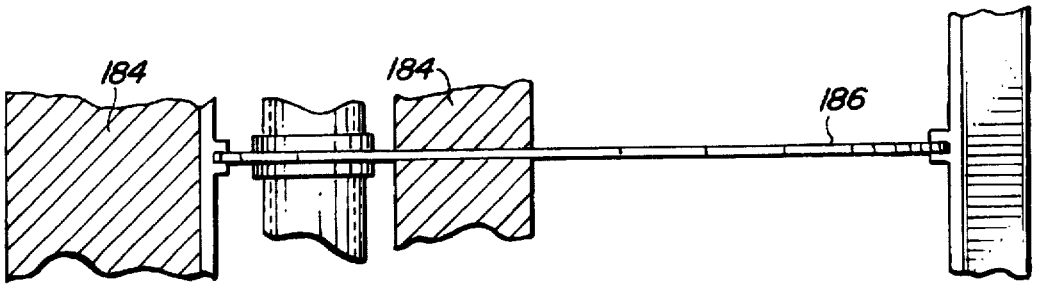
FIG. 18B is a cut-away top view of the foil of FIG. 18A, taken along a line 18B—18B thereof.

Referring to FIGS. 18A, 18B and again to FIG. 6, the foil 18 includes skeletal stiffening members 186 that strengthen the foil so that it may resist swimming forces. The foil 18 is preferably not watertight, so a distribution of foam 184 is preferably employed to control the center of buoyancy of the foil. The density and distribution of the foam 184 is selected so that the center of buoyancy of the foils 18 is located at substantially about the aforedescribed 30% position 54.

Referring again to FIGS. 1 and 13, a fairing 160 comprises the channeling member 22 which projects downwardly as the swimmer swims. The fairing houses the extensible arm 73 and the slew rate and attitude control mechanism 110, and overlays the structural members 31. The first axle 39 and the second axle 57 extend through the fairing to connect to the foils 18 and 20 respectively. The hub 48 extends through the fairing at a slot 162, the slot being adapted to permit the outer leaf 54 of the hub to rotate throughout its range of motion without interfering with the fairing. The fairing also provides room for the extensible arm 73 and the slew rate and attitude control mechanism 110 to move internally therein. The fairing 160 preferably includes an adjustable thigh pad 168 adapted for adjustable extension, in and out, to meet the swimmer's leg and thereby to help stabilize, along with the leg harness 152, the apparatus 10 (see FIG. 12). In addition, the fairing functions to reduce drag. The fairing may be fastened to the leg cuff 16 by bonding, such as with an adhesive, or with the use of fasteners such as rivets or clips, or in any other advantageous manner known in the art.

The channeling member 22 is advantageously shaped and situated to apportion water flowing thereacross between the outside foil 18 and the inside foil 20, in order to balance the forces the swimmer applies to the water through the two foils.

Figure 19:
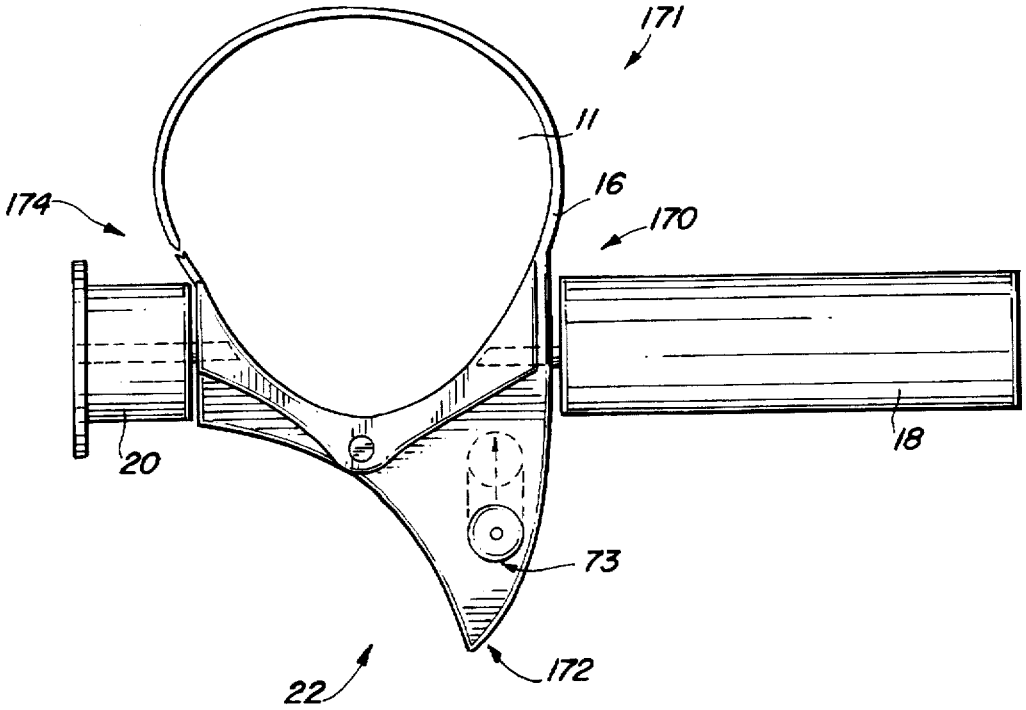
FIG. 19 is a cross-section of a swimmer's leg having attached thereto the swim apparatus of FIG. 1, particularly showing a longitudinal ridge according to the present invention.

Referring to FIG. 19, the cross-sectional shape 171 of the channeling member descends steeply, away from the swimmer's leg 11, from the leg cuff 16 on the side 170 thereof proximal to the outside foil 18, terminates in a ridge 172, and ascends concavely, toward the swimmer's leg, to the leg cuff 16 on the side 174 thereof proximal to the inside foil 20. The channeling member 22 is preferably biased toward the outside foil 18, because the outside foil has larger working surfaces 28 and 30 than does the inside foil 20, as discussed in OPERATION below.

Referring again to FIG. 13, the profile 173 of the channeling member 22 is substantially convex. The profile 173 curves downwardly from about the swimmer's knee and becomes substantially parallel to the swim direction 14 proximate the swimmer's foot.

The channeling member 22 may employ other shapes and configurations in order to accomplish its purpose of guiding water over the apparatus 10 and dividing water between the foils 18 and 20, as will be appreciated by those of ordinary skill in the art. As will also be appreciated, it is preferable that the channeling member employ shapes and configurations which tend to minimize drag.

OPERATION

The leg cuff 16 is attached to the lower portion of the swimmer's leg by opening the cuff at the hinge 24, placing the cuff around the leg 11, closing and then fastening the cuff.

Figure 10A:
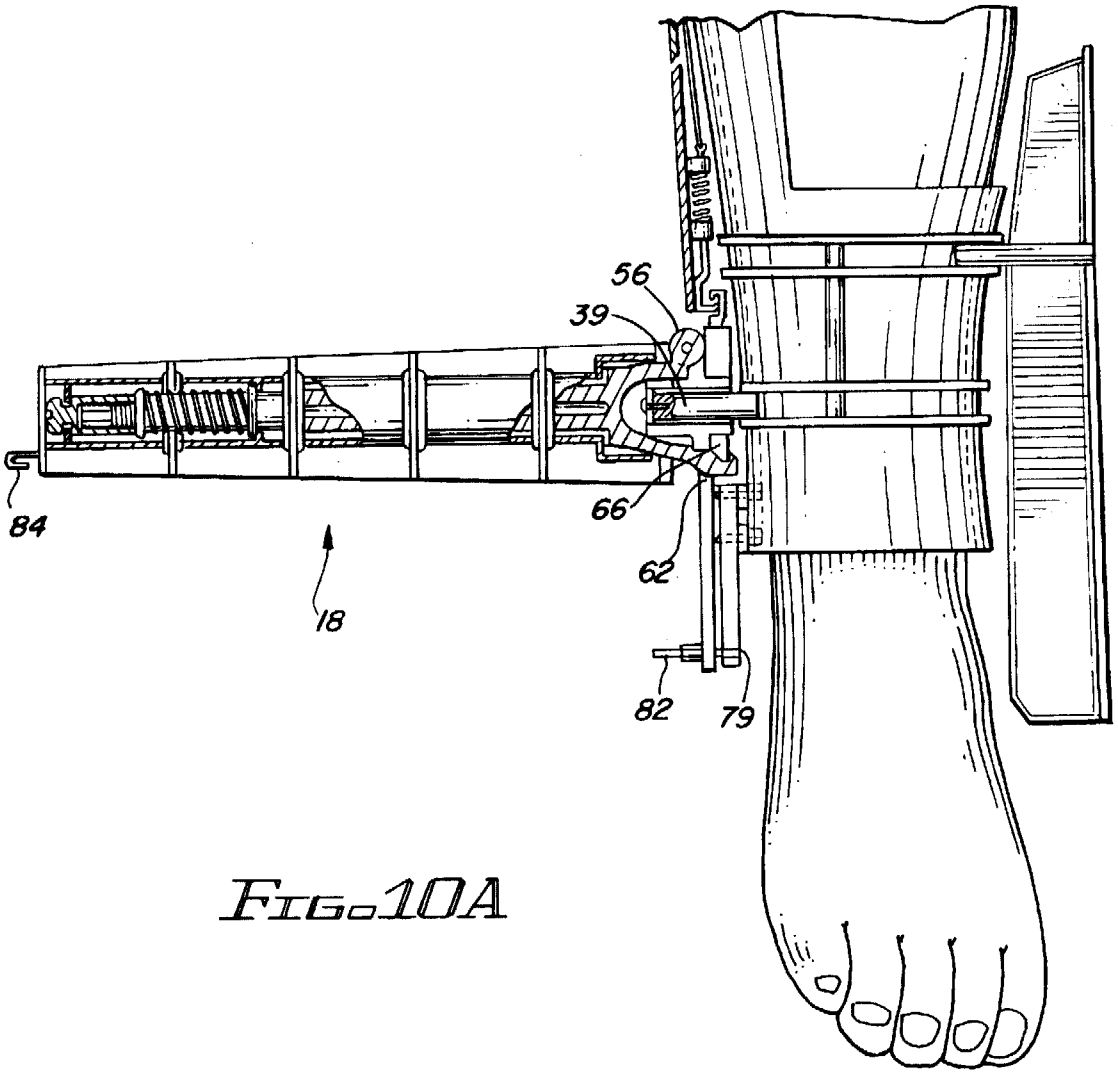
FIG. 10A is a plan view of the apparatus of FIG. 6 with the outside foil rotated about 90 degrees out of the working position.
Figure 10B:
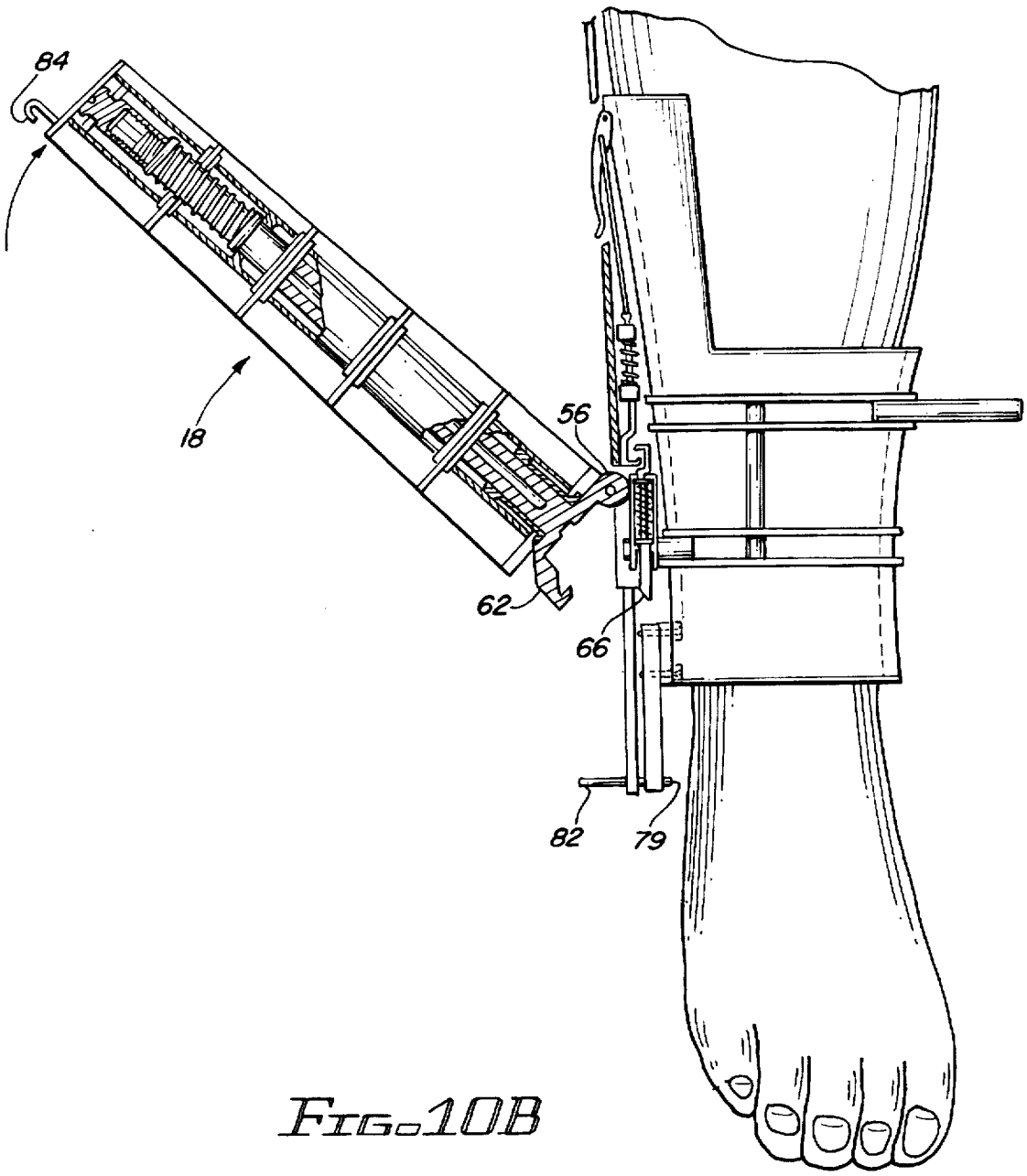
FIG. 10B is a plan view of the apparatus of FIG. 6 with the outside foil of FIG. 6 pivoted about 45 degrees toward a stowage position.
Figure 11:
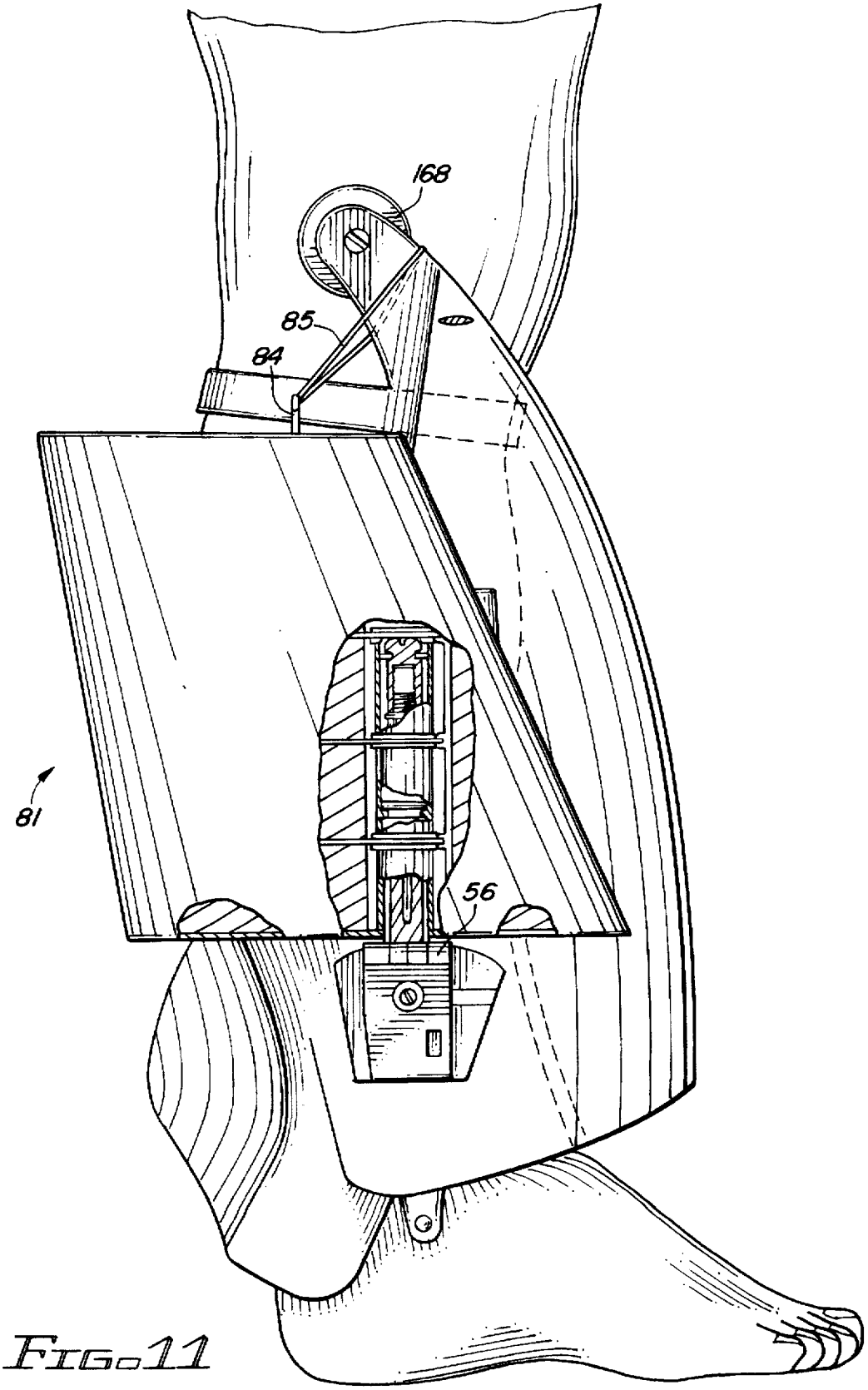
FIG. 11 is a pictorial view of the swim apparatus of FIG. 1 with the outside foil of FIG. 6 in a stowage position.
Figure 20:
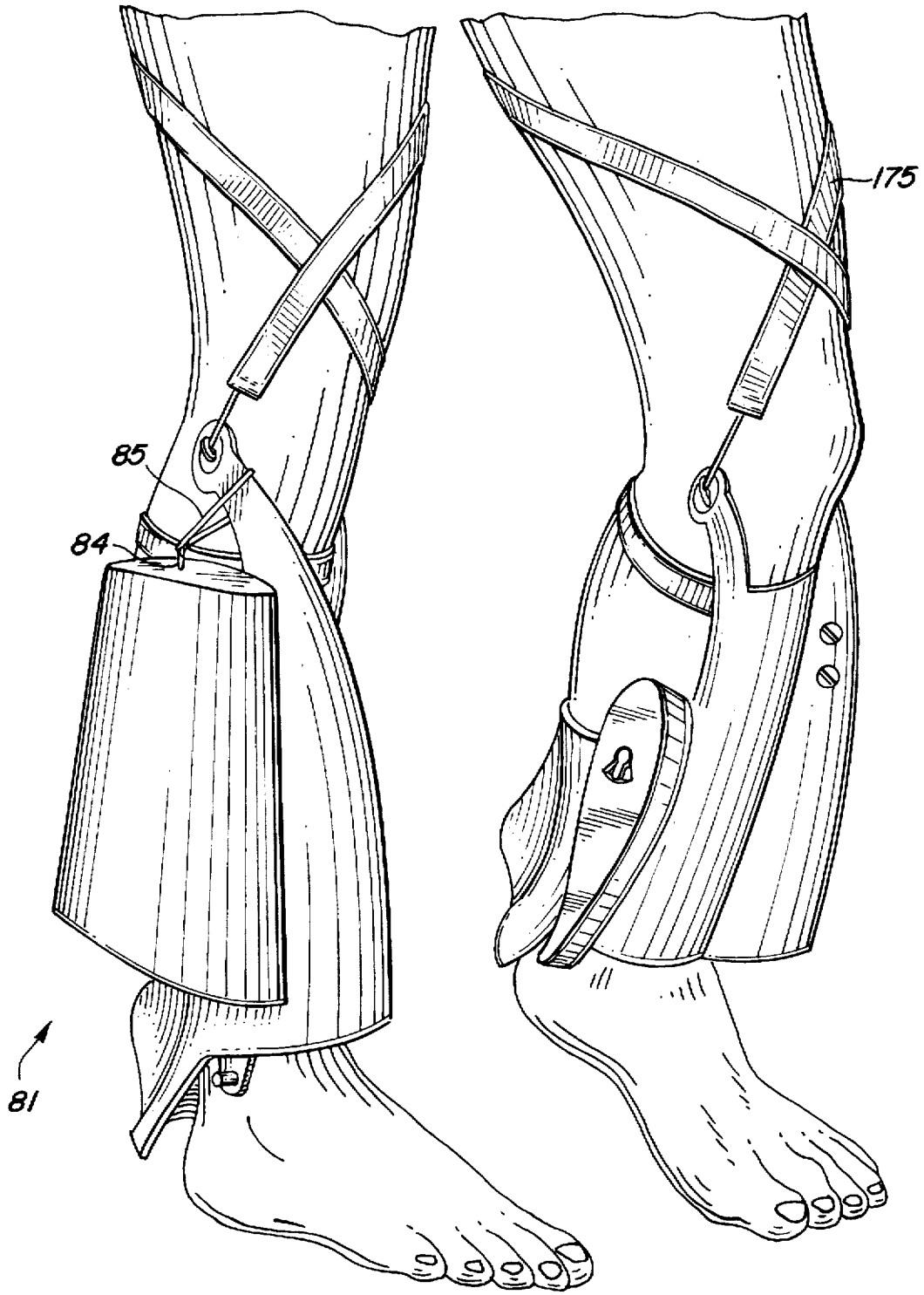
FIG. 20 is a pictorial view of the swim apparatus of FIG. 1 with the outside foil of FIG. 6 in a stowage position, the swim apparatus being supported in part by leg straps according to the present invention.

As depicted in FIG. 20, the swimmer may walk with the apparatus in a stowage position 81. Referring to FIGS. 110A, 10B and 11, the foil 18 may be unlocked from its working position by pulling the foil outwardly against the spring 78, thereby releasing the aperture 83 from the pin 82. The foil may now be rotated about the axle 39 substantially about 90 degrees in anticipation of stowage (see FIG. 110A). Thereafter, the latch arm 62 may be unlatched by withdrawing the latch pin 66, preferably as described below. The hinge 56 may now be opened, so that the foil may be pivoted at the hinge 56 substantially about 90 degrees out of the working position and into the stowing position 81 (see FIGS. 10B and 11), the opened hinge 56 permitting the foil 18 to be folded substantially flat against the swimmer's leg. The hook 84 on the foil and a tie strap 85 attached to the cuff 16 are employed to secure the foil 18 in the stowage position 81. When the swimmer is ready to swim, the aforedescribed process is reversed.

Figure 21:
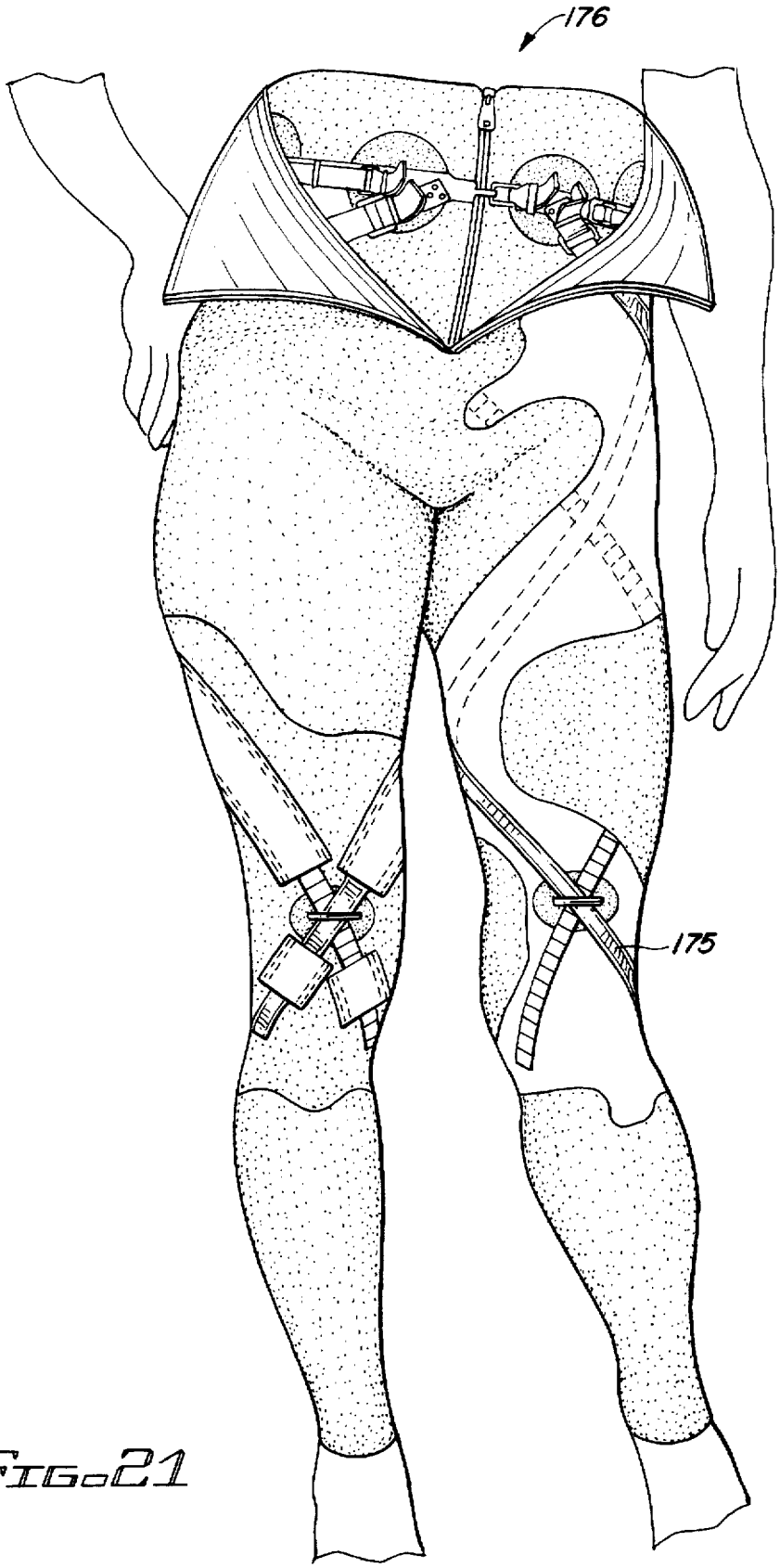
FIG. 21 is a pictorial view of preferred wet-suit for use with the present invention, the wet-suit incorporating the leg straps of FIG. 20.

FIG. 20 also depicts leg straps 175 which advantageously function to resist twisting of the swimmer's leg in response to torsional forces that may be encountered in swimming with the apparatus 10. Referring to FIG. 21, it is preferred that the swimmer employ a wet-suit 176 which includes the leg straps 175 for use with larger foils 18, wherein a larger foil 18 has a top surface 26 of greater than about 80–100 square inches. However, use of the wetsuit 176 is not requested to practice the invention, nor is it always particularly advantageous.

The channeling member 22 divides the flow of water between the outside foil 18 and the inside foil 20 resulting from a thrust leg stroke, to balance the forces applied to the foils thereby in order to decrease or eliminate torsion in the swimmer's leg. However, the surface area of the outside foil 18 is relatively large compared to the surface area of the inside foil 20. Thence, to achieve approximately balanced flow effects on each foil, it has been found that more water may be channeled to the inside foil 18 by biasing the location of the channeling member 22 toward the outside foil 18. The channeling member should produce minimum drag for a given amount of water channeled. It is believed that the aforedescribed cross-sectional shape 171 and profile 173 of the channeling member minimize drag.

The inside foil 20 includes the fence plate 46 which has been found to enhance the balancing effect of water flowing over the inside foil, by tending to retain water having higher velocity over the top surface 30 of the foil.

The shape of the outside foil 18 and the control of its angle of attack with respect to a swimmer's leg strokes is patterned after the shape and observed swimming movements of a dolphin. With respect to this shape, the rearward portion 40 of the profile 26 is configured to mimic the shape of an aft portion of the dolphin's body, which includes its tail flukes.

With respect to the dolphin's swimming movements, the dolphin has been observed to thrust an aft portion of its body downwardly while manipulating its tail flukes to maintain an optimum angle of attack. At the bottom of a thrust stroke, the dolphin holds a leading edge of the flukes downwardly with respect to the horizontal to create a 15 degree to 40 degree negative angle of attack. As the dolphin raises the aft portion of its body during a return stroke, the flukes make a transition to a positive angle of attack, also of 15 to 40 degrees.

In the present invention, rotation of the foil 18 with respect to the hub may be controlled in response to the swimmer's leg strokes through the extensible arm 73 and the slew rate and attitude control mechanism 110. The foil 18 changes its attitude or angle of attack from a neutral position either upwardly or downwardly in response to force being applied to the foil 18 as a result of the resistance of the mechanism 110. The range of angle of attack is limited by the geometry of the control arm 61 and the extensible arm 73, as well as by the mechanism 110. As aforementioned, the range is preferably limited to between a negative 25 degrees with respect to the swimmer's leg during a thrust stroke and a positive 25 degrees during a return stroke.

The rate of foil response may be adjusted to match a particular swimmer's swimming characteristics by adjusting the valves 136*a*, 136*b* of the mechanism 110. The effective size of the respective chambers 134*a*, 134*b* is preferably adjusted so that the rate of expulsion of water is timed to match the rate of the swimmer's thrust leg stroke for the force the swimmer is typically able to apply therewith. A calculation of this rate and a determination of the adjustment required in the bleed mechanism 136 is preferably made with the aid of a small, special purpose computer or calculator.

With reference to FIGS. 22A–22I, as the swimmer's leg is thrust downwardly, the foil 18 is permitted to assume a negative angle of attack. Normal force applied to the bottom surface 28 of the foil 18 is transmitted to the hub 48, tending to twist the hub in the direction of foil declination. This twisting is transmitted to the hub control arm 61, which in turn pulls the extensible arm 73 to displace the piston 114 toward the end 122*a* of the fixed cylinder 116. Water, trapped between the back surface 120*a* of the piston and the end 122*a* of the cylinder, is thereby forced by the piston through the outlet 128*a* and flexible tube 130*a*, at a rate governed by the selected adjustment of the valve 136*a*, the pressure in the cylinder, and the viscosity of the water. At the same time, the volume of the cylinder between the back surface 120*b* of the piston 114 and the end 122*b* of the cylinder is thereby increased, tending to draw water in at the inlet 126*b* through the check valve 127*b* to fill the cylinder between the surface 120*b* and 122*b*.

As the swimmer's leg is thrust upwardly, the foil 18 is permitted to assume a positive angle of attack. Normal force applied to the top surface 30 of the foil 18 is transmitted to the hub 48, tending to twist the hub in the direction of foil inclination. This twisting is transmitted to the hub control arm 61, which in turn pushes the extensible arm 73 to displace the piston 114 toward the end 122*b* of the fixed cylinder 116. Water, trapped between the back surface 120*b* of the piston and the end 122*b* of the cylinder, is thereby forced by the piston through the outlet 128*b* and flexible tube 130*b*, at a rate governed by the selected adjustment of the valve 136*b*, the pressure in the cylinder, and the viscosity of the water. At the same time, the volume of the cylinder between the back surface 120*a* of the piston 114 and the end 122*a* of the cylinder is thereby increased, tending to draw water in at the inlet 126*a* through the check valve 127*a* to fill the cylinder between the surface 120*a* and 122*a*.

Figure 22A:
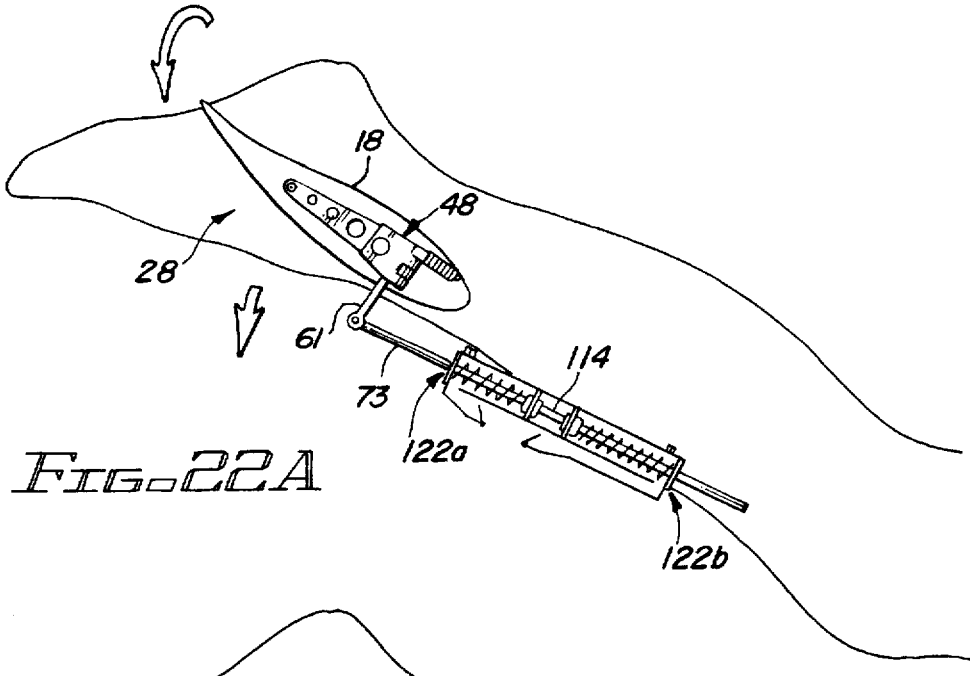
FIG. 22A is a side elevation of the swim apparatus of FIG. 1 substantially at the commencement of a swimmer's thrust stroke.
Figure 22B:
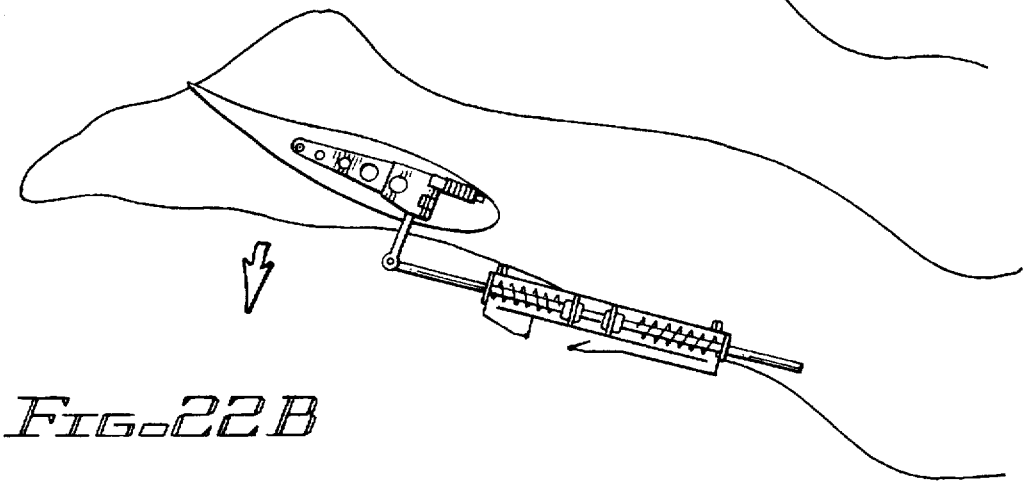
FIG. 22B is a side elevation of the swim apparatus of FIG. 22A substantially a quarter way through the swimmer's thrust stroke.
Figure 22C:
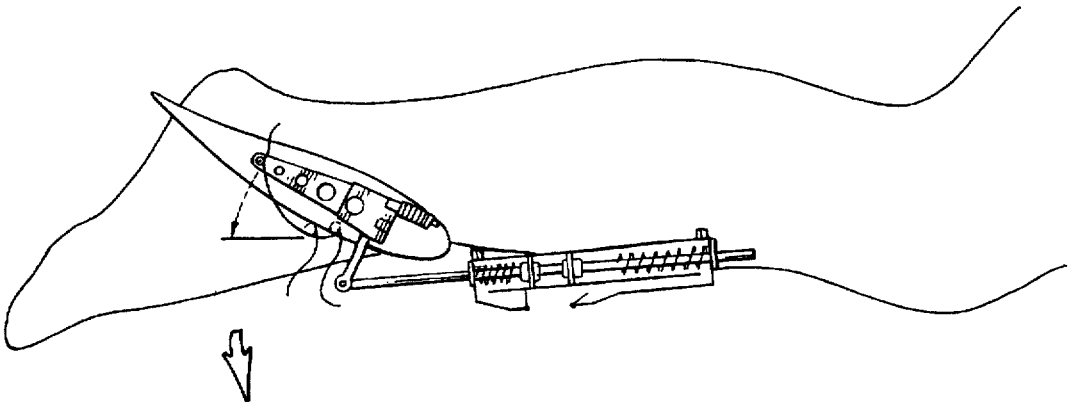
FIG. 22C is a side elevation of the swim apparatus of FIG. 22A substantially half way through the swimmer's thrust stroke, the Figure also showing a delay spring according to the present invention.
Figure 22D:
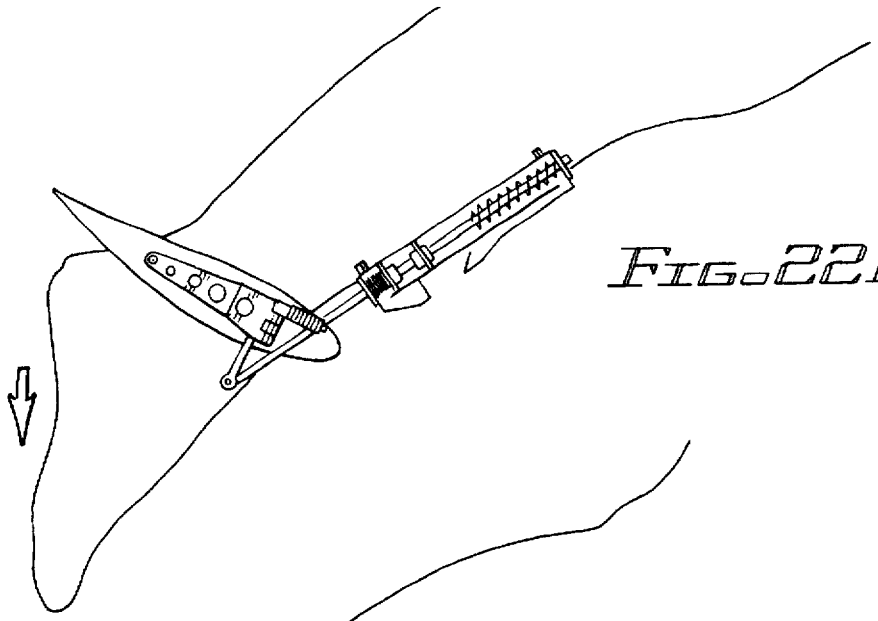
FIG. 22D is a side elevation of the swim apparatus of FIG. 22A substantially at the bottom of the swimmer's thrust stroke.
Figure 22E:
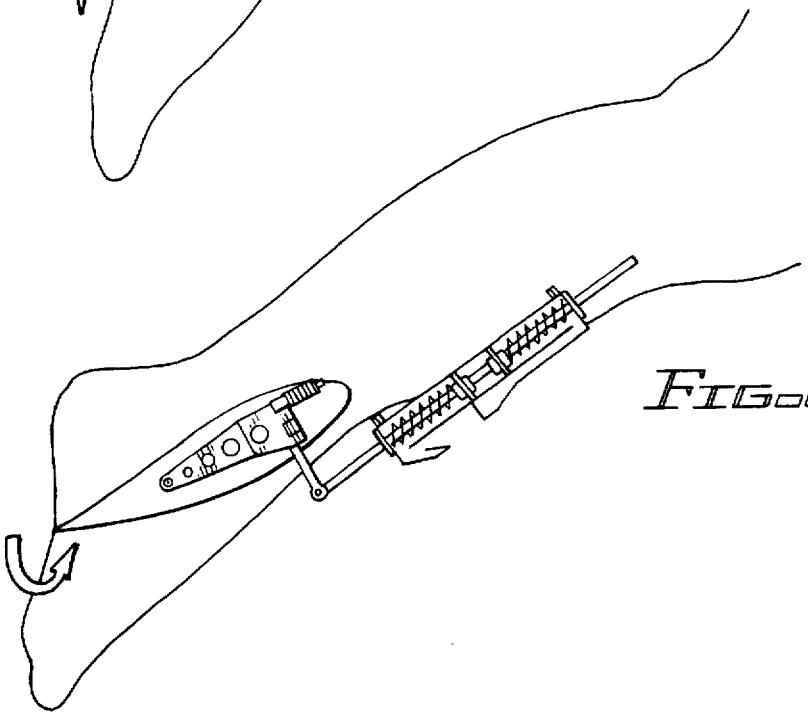
FIG. 22E is a side elevation of the swim apparatus of FIG. 22A at the commencement of the swimmer's return stroke.
Figure 22F:
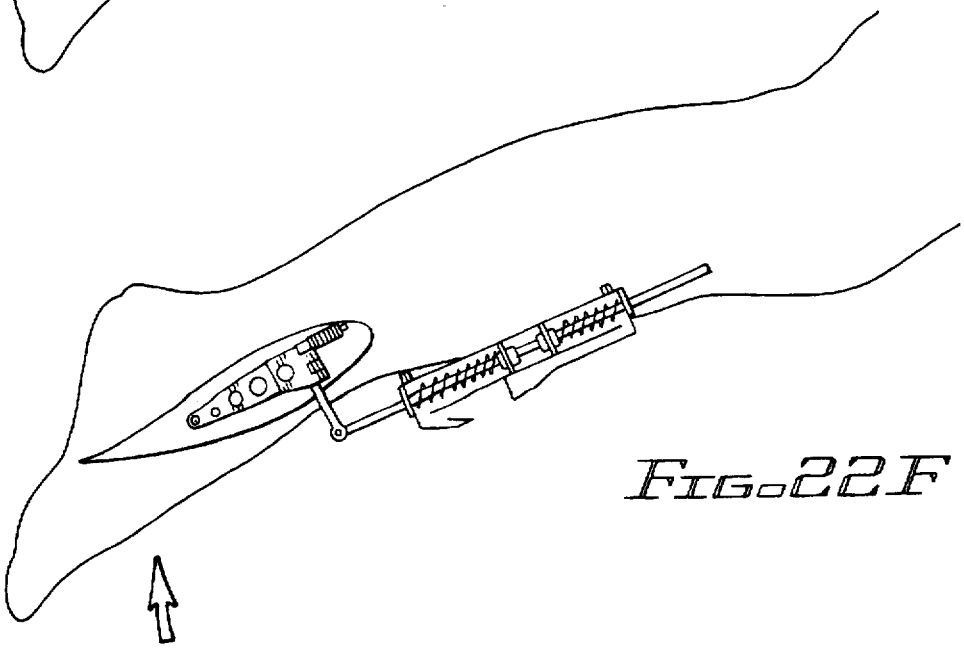
FIG. 22F is a side elevation of the swim apparatus of FIG. 22A substantially a quarter way through the swimmer's return stroke.
Figure 22G:
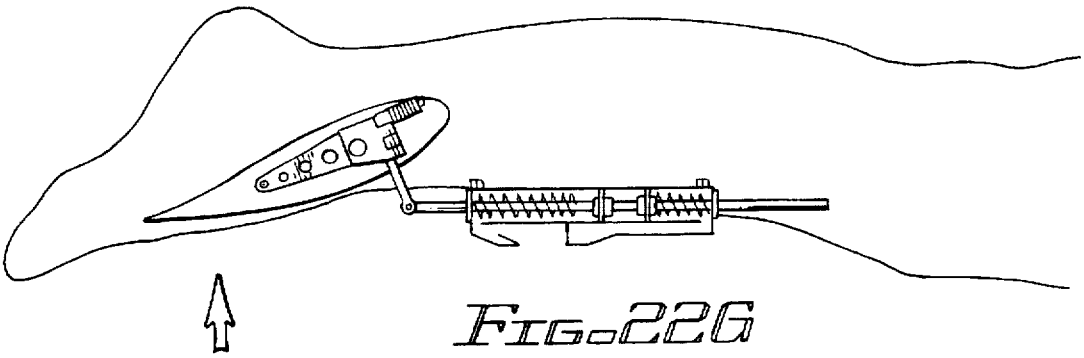
FIG. 22G is a side elevation of the swim apparatus of FIG. 22A substantially half way through the swimmer's return stroke.
Figure 22H:
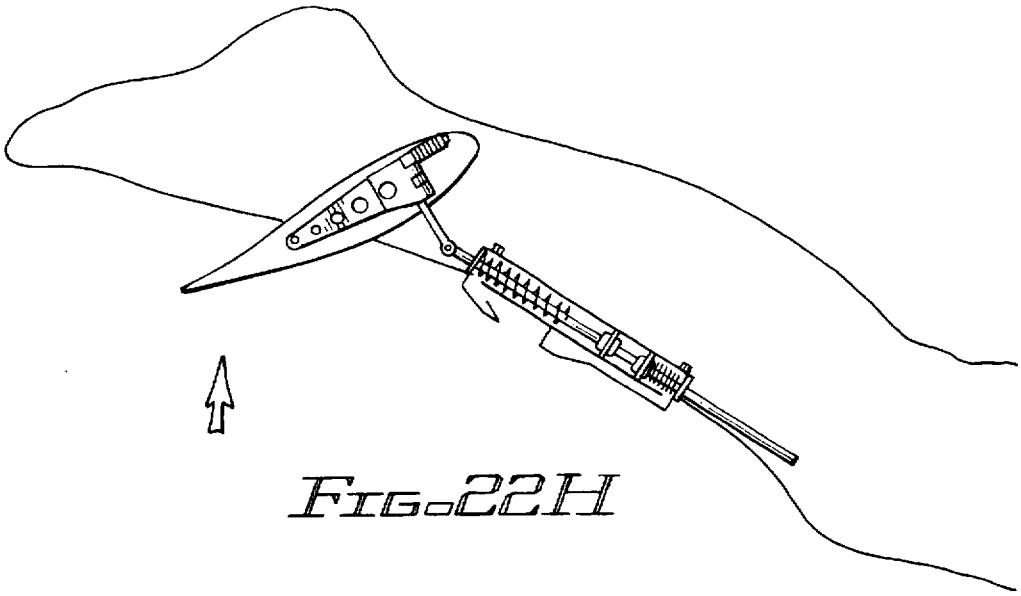
FIG. 22H is a side elevation of the swim apparatus of FIG. 22A substantially at the top of the swimmer's return stroke.
Figure 22I:
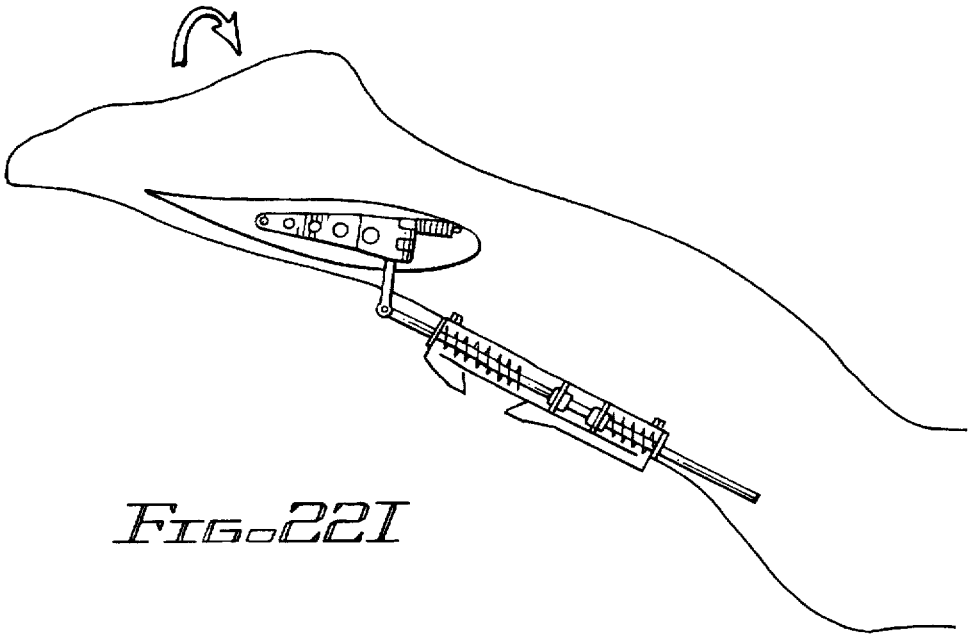
FIG. 22I is a side elevation of the swim apparatus of FIG. 22A substantially at the commencement of the swimmer's thrust stroke.

The operation of the delay mechanism 138 will next be described. It has been found to be advantageous to retard the foil transition during the beginning portion of the thrust stroke. FIG. 22A depicts the delay spring 140 of the mechanism 138 during the thrust stroke. The delay spring is stopped at the mid-position 145 from upward travel by the stop 143. However, the distal end 141 of the spring is free to bend around the stop 143. During the beginning portion of the thrust stroke, shown in FIGS. 22A–22C, the delay spring pin 79 (see FIG. 12) contacts the distal end 141 of the spring 140 and pushes it upwardly so that the spring bends around the stop. But, because the pivot radius of the pin 79 is greater than the pivot radius of the spring 140 as stopped by the stop 143, the distal end 141 eventually loses contact with, and is thereby released by, the pin 79 (FIG. 22C). Thence, during the early part of the thrust stroke, the spring 140 acts to retard rotation of the foil 18, while at a later part of the stroke, the spring releases, and foil rotation is governed solely by the piston and cylinder assembly 112. During the return stroke, the spring is restored to its original position, again, because of the respective differences in the pivot radii between the spring and the pin 79. The spring 140 does not affect the return stroke.

It is to be recognized that, while a specific aquadynamic swim apparatus and method for use thereof has been shown as preferred, other configurations could be utilized, in addition to configurations already mentioned, without departing from the principles of the invention. Particularly, any number of foils and channeling members may be employed, and any of these may employ any of the principles attributed to any of the foils 18, 20 and 182, or the channeling member 22.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

I claim:

1. An apparatus for aiding a swimmer to swim, comprising:

a leg cuff adapted to attach to a leg of the swimmer;

a first foil connected to said leg cuff, said first foil having a working surface and a working surface profile having a curvilinear shape taken along a longitudinal plane of said working surface;

said first foil being pivotally coupled to said leg cuff so as to permit relative rotation therebetween, an attitude control mechanism coupled between said first foil and said leg cuff for controlling said rotation of said first foil; and said attitude control mechanism comprising:

a control arm coupled to said first foil and extending away from said working surface, and an extensible member pivotally coupled to said control arm at a distal end of said control arm a length of said extensible member self adjusting in response to a force applied to said working surface.

2. The apparatus of claim 1, wherein said profile of said working surface is cambered.

3. The apparatus of claim 2, wherein said cambered working surface is a lower surface of said first foil.

4. The apparatus of claim 1, wherein said first foil is pivotally connected to said leg cuff so as to permit said rotation of said foil about an axis lying substantially in the swimmer's coronal plane.

5. The apparatus of claim 4, further comprising a delay mechanism connected to said leg cuff, said delay mechanism being disposed so as to contact said first foil during selected portions of the swimmer's swimming stroke and being adapted to retard rotation of said first foil during said contact.

6. The apparatus of claim 5, wherein said delay mechanism includes a leaf spring, said leaf spring having a distal end for making said contact with said foil at a projection thereon, said projection having a first pivot radius and said leaf spring having a second pivot radius which is smaller than said first pivot radius.

7. The apparatus of claim 1, wherein said attitude control mechanism is adapted to control said rotation in relation to the forces applied to said first foil by the swimmer's swim strokes.

8. The apparatus of claim 1, wherein said extensible member includes a slew rate control mechanism and attitude adjustment mechanism disposed therein, said slew rate control mechanism controlling the rate at which said extensible member self-adjusts.

9. The apparatus of claim 8, wherein said slew rate control mechanism includes a substantially confined working fluid and an adjustable valve mechanism adapted to permit said working fluid to escape confinement at a predetermined rate, and wherein said extensible member is adapted to pressurize said working fluid in response to a force applied to said working surface of said first foil.

10. The apparatus of claim 9, wherein said predetermined rate is adjusted to correlate with the rate of the swimmer's swimming strokes.

11. The apparatus of claim 10, wherein said extensible member self-adjusts to limit the inclination and declination of said first foil to substantially about 25 degrees.

12. The apparatus of claim 1, further comprising a second foil projecting from said leg cuff on a side of the swimmer's leg substantially opposite from a side of the swimmer's leg from which said first foil projects, to help minimize twisting of the swimmer's leg during swimming strokes.

13. The apparatus of claim 12, wherein said second foil is rotatably connected to said leg cuff.

14. The apparatus of claim 13, further comprising limiting means for limiting the inclination and declination of said second foil.

15. The apparatus of claim 14, wherein said limiting means limits the inclination and declination of said second foil to substantially about 40 degrees.

16. The apparatus of claim 12, wherein said second foil includes a fence substantially perpendicular to a working surface of said second foil, to resist a flow of water thereover.

17. The apparatus of claim 12, wherein said second foil includes a working surface and a profile taken along a plane substantially parallel to said working surface, wherein said profile is substantially that of a transonic airfoil.

18. The apparatus of claim 12, further comprising a channeling member disposed between said first foil and said second foil, for apportioning a flow of water therebetween.

19. The apparatus of claim 1, wherein said leg cuff includes means for stowing said first foil against the swimmer's leg to permit walking with the apparatus.

20. An apparatus for aiding a swimmer to swim, comprising:

a leg cuff adapted to attach to a leg of the swimmer;

a first foil coupled to said leg cuff, said first foil including a working surface and a working surface profile having a curvilinear shape taken along a longitudinal plane, said first foil being pivotally coupled to said leg cuff so as to permit rotation therebetween, a delay mechanism coupled to said leg cuff and structured to selectively retard said rotation of said foil relative to said leg cuff, and said delay mechanism including a leaf spring, said leaf spring being structured to make contact with said first foil at a projection thereon, said projection including a first pivot radius and said leaf spring including a second pivot radius which is smaller than said first pivot radius.

21. An apparatus for aiding a swimmer to swim, comprising:

a leg cuff adapted to attach to a leg of the swimmer;

a first foil coupled to said leg cuff;

a second foil coupled to said leg cuff and projecting from leg cuff on a side of the swimmer's legs substantially opposite from a side of the swimmer's leg from which said first foil projects; and a channeling member disposed between said first foil and said second foil, said channeling member structured to apportion a flow of water between said first foil and said second foil.

22. An apparatus for aiding a swimmer to swim, comprising:

a leg cuff adapted to attach to a leg of the swimmer, a first foil connected to said leg cuff, and said leg cuff including means for stowing said first foil against the swimmer's leg to permit walking with the apparatus.

* * * * *